US012735878B2

(12) United States Patent
Yee et al.

(10) Patent No.: US 12,735,878 B2
(45) Date of Patent: Sep. 15, 2026

(54) FAUCET WITH INTEGRATED SOAP DISPENSER

(71) Applicant: Kohler Co., Kohler, WI (US)

(72) Inventors: Evan Yee, Grafton, WI (US); Gabriel Niederlander, Sheboygan, WI (US); Azzar Sidoney Bubb, Atlanta, GA (US)

(73) Assignee: Kohler Co., Kohler, WI (US)

( * ) Notice: Subject to any disclaimer, the term of this patent is extended or adjusted under 35 U.S.C. 154(b) by 812 days.

(21) Appl. No.: 17/321,117

(22) Filed: May 14, 2021

(65) Prior Publication Data

US 2021/0363736 A1 Nov. 25, 2021

Related U.S. Application Data

(60) Provisional application No. 63/027,380, filed on May 20, 2020.

(51) Int. Cl.
*E03C 1/046* (2006.01)
*A47K 5/12* (2006.01)
*E03C 1/05* (2006.01)

(52) U.S. Cl.
CPC ..... *E03C 1/046* (2013.01); *A47K 5/1217* (2013.01); *E03C 1/057* (2013.01); *A47K 2005/1218* (2013.01)

(58) Field of Classification Search
CPC ..... E03C 1/046; E03C 1/057; E03C 1/0412; E03C 2001/0415; E03C 1/04; E03C 1/0401; E03C 1/0404; E03C 2001/0416; E03C 2001/0417; E03C 2001/0414; A47K 5/1217; A47K 2005/1218
USPC ..... 239/310
See application file for complete search history.

(56) References Cited

U.S. PATENT DOCUMENTS 1,050,971 A * 1/1913 Meacham ..... F16L 37/23 138/40
1,075,483 A * 10/1913 Lindgren ..... E03B 9/20 239/25
1,240,260 A * 9/1917 Rudolph ..... E03B 9/20 239/289
1,396,380 A * 11/1921 Hormidas ..... E03B 9/20 239/25
2,302,097 A * 11/1942 Beckman ..... A47L 17/00 137/892
5,016,297 A 5/1991 Sauter et al.
5,644,943 A 7/1997 Lanz
(Continued)

FOREIGN PATENT DOCUMENTS

CA 2203227 C 6/2005

*Primary Examiner* — Tuongminh N Pham
*Assistant Examiner* — Anna Thi Ho
(74) *Attorney, Agent, or Firm* — Husch Blackwell LLP

(57) ABSTRACT

A faucet having an integrated dispensing device is provided. The faucet includes a center shaft centered on an axis, a handle portion extending away from the center shaft at a first angle and coupled to the center shaft, and a dispensing device rotatably coupled to the center shaft about the axis. The dispensing device includes a dispensing body and a dispensing arm. The dispensing body defines a first end proximate to the handle portion and a second end opposite the first end. The dispensing arm is coupled with the dispensing body and extends away from the dispensing body at a second angle, the second angle being the same as the first angle.

16 Claims, 17 Drawing Sheets

(56) References Cited

U.S. PATENT DOCUMENTS 5,797,150 A 8/1998 Lanz
6,142,342 A * 11/2000 Lewis ..... A47K 5/1205 222/325
6,202,980 B1 * 3/2001 Vincent ..... E03C 1/05 251/129.04
6,467,651 B1 * 10/2002 Muderlak ..... B05B 12/02 222/63
6,651,851 B2 * 11/2003 Muderlak ..... B05B 11/1008 222/333
7,025,227 B2 * 4/2006 Oliver ..... A47K 5/1217 222/61
7,364,053 B2 * 4/2008 Ophardt ..... A47K 5/16 222/145.5
7,458,523 B2 * 12/2008 Hyslop ..... E03C 1/0404 239/311
7,681,765 B2 * 3/2010 Muderlak ..... A47K 5/16 222/375
7,815,074 B2 * 10/2010 Ciavarella ..... A47K 5/12 141/383
8,844,070 B2 9/2014 Booth et al.
9,096,995 B1 * 8/2015 Al-Qaneei ..... E03C 1/0465
9,173,487 B2 11/2015 Booth et al.
9,492,011 B2 11/2016 Booth et al.
9,574,333 B2 2/2017 O'Brien et al.
9,777,468 B2 * 10/2017 Burgo, Sr. ..... A47K 5/12
9,995,025 B2 * 6/2018 Wang ..... A47K 5/1217
10,010,223 B2 * 7/2018 Burgo, Sr. ..... A47K 5/14
10,125,481 B2 11/2018 Booth et al.
10,349,787 B2 * 7/2019 Burgo, Sr. ..... A47K 5/1202
10,428,498 B1 * 10/2019 Montague ..... E03C 1/057
10,450,731 B2 * 10/2019 McHale ..... E03C 1/046
10,687,620 B2 6/2020 Booth et al.
10,704,241 B2 7/2020 Miller
2009/0100593 A1 * 4/2009 Lincoln ..... E03C 1/057 4/623
2009/0101679 A1 * 4/2009 Muderlak ..... A47K 5/16 222/375
2009/0166381 A1 * 7/2009 Phelps ..... A47K 5/12 222/173
2011/0186161 A1 * 8/2011 Chen ..... G05D 23/1927 137/637
2013/0075420 A1 * 3/2013 Tramontina ..... A47K 5/1205 222/1
2013/0186479 A1 * 7/2013 Zhu ..... E03C 1/06 137/15.01
2014/0124540 A1 * 5/2014 Ciavarella ..... B05B 7/0037 222/173
2014/0231450 A1 * 8/2014 Rosko ..... A47K 5/1211 222/52
2018/0355593 A1 * 12/2018 Tracy ..... E03C 1/057
2019/0191874 A1 6/2019 Booth et al.
2019/0365161 A1 12/2019 Burgo et al.
2020/0063407 A1 * 2/2020 Zhu ..... E03C 1/0404
2020/0268150 A1 8/2020 Booth et al.
2020/0270853 A1 * 8/2020 Le ..... G01F 15/06
2021/0059481 A1 * 3/2021 Bai ..... A47K 5/16
2021/0189703 A1 * 6/2021 Schmitt ..... E03C 1/057
2021/0346240 A1 * 11/2021 Perrin ..... E03C 1/086
2021/0353111 A1 * 11/2021 Hofman ..... A47K 5/1202

* cited by examiner

FAUCET WITH INTEGRATED SOAP DISPENSER

CROSS-REFERENCE TO RELATED PATENT APPLICATION

This application claims the benefit of and priority to U.S. Provisional Application No. 63/027,380, filed on May 20, 2020, the entire disclosure of which is incorporated by reference herein.

BACKGROUND

The present disclosure relates generally to the field of integrated dispensing devices for use in a kitchen or bathroom environment.

Conventional soap dispensers include fixed, counter-top integrated units with replaceable soap receptacles and portable units, such as bottles with soap-dispensing spouts. One conspicuous disadvantage of such soap dispensers is that they take up space on the counter top and may not match the faucet. Further, the soap dispenser may be knocked over during regular activities, such as washing hands or cleaning dishes.

SUMMARY

According to an example embodiment, a faucet is provided. The faucet includes a center shaft centered on an axis, a handle portion extending away from the center shaft at a first angle and coupled to the center shaft, and a dispensing device rotatably coupled to the center shaft about the axis. The dispensing device includes a dispensing body and a dispensing arm. The dispensing body defines a first end proximate to the handle portion and a second end opposite the first end. The dispensing arm is coupled with the dispensing body and extends away from the dispensing body at a second angle, the second angle being the same as the first angle.

According to another embodiment, a faucet is provided. The faucet includes a center shaft centered on an axis, a handle portion extending away from the center shaft, and a dispensing device rotatably coupled to the center shaft about the axis. The dispensing device includes a body and an arm. The body includes a first end and a second end opposite the first end. The arm is coupled with the body proximate to the first end and has a geometry that is complementary to a geometry of the handle portion such that the dispensing arm nests with the handle portion to form a continuous visual surface. The arm further includes a nozzle, a sensor positioned within the arm and coupled to the arm, and a sensor interface operable to actuate the sensor positioned within the arm.

According to another embodiment, a faucet is provide. The faucet includes a center shaft defining a central axis and a dispensing device rotatably coupled to the center shaft and positionable between a nested position and a use position. The dispensing device includes a dispensing body and a dispensing arm. The dispensing body defines a first end and a second end opposite the first end. The dispensing arm is coupled with the dispensing body proximate to and extending orthogonally away from the dispensing body. The dispensing arm includes a sensor, a first sensor interface, and a second sensor interface. The sensor is coupled within the dispensing arm and is configured to send a signal to a controller to discharge a fluid from the dispensing arm. The first sensor interface is operable to actuate the sensor when the dispensing device is in either one of the nested position and the use position. And the second sensor interface is operable to actuate the sensor when the dispensing device is in the use position.

BRIEF DESCRIPTION OF THE DRAWINGS

The details of one or more implementations are set forth in the accompanying drawings and the description below. Other features, aspects, and advantages of the disclosure will become apparent from the description, the drawings, and the claims, in which:

It will be recognized that some or all of the Figures are schematic representations for purposes of illustration. The Figures are provided for the purpose of illustrating one or more implementations with the explicit understanding that they will not be used to limit the scope or the meaning of the claims.

DETAILED DESCRIPTION

Before turning to the Figures, which illustrate certain exemplary embodiments in detail, it should be understood that the present disclosure is not limited to the details or methodology set forth in the description or illustrated in the Figures. It should also be understood that the terminology used herein is for the purpose of description only and should not be regarded as limiting. Below are more detailed descriptions of various concepts related to, and implementations of, methods, apparatuses, and systems for faucets having an integrated dispensing device. The various concepts introduced above and discussed in greater detail below may be implemented in any of a number of ways, as the described concepts are not limited to any particular manner of implementation. Examples of specific implementations and applications are provided primarily for illustrative purposes.

Generally speaking, a faucet and a dispensing device, such as for liquid soap, are separate from one another. For example, pump dispensers, whether disposable or refillable, are separate from the faucet and susceptible to being knocked over. They can also leave rings of soap on the tops of counters, behind sinks, and on other flat surfaces the soap dispensers may be mounted.

Some soap dispensers may be mounted into a mounting hole in a counter top, commonly seen in public restrooms. These soap dispensers may be motion-activated, proximity-sensor activated, or pump activated. However, these soap dispensers require an additional hole in the counter top, which may be costly to add, especially for stone, granite, and quartz counter tops.

Lastly, some soap dispensers may be attached to a pre-existing faucet, either in a bathroom sink or a kitchen sink. However, these after-market products may be clunky, expensive, corrode, or inhibit normal use of the faucet.

Thus, it would be desirable to provide a faucet having an integrated dispensing device that is functional, out of the way, and matches well with the faucet. Combining a dispensing device with a faucet may reduce the part-count, increase the accessibility of the dispenser, and allow for a less hectic work environment.

Figures 1, 2:
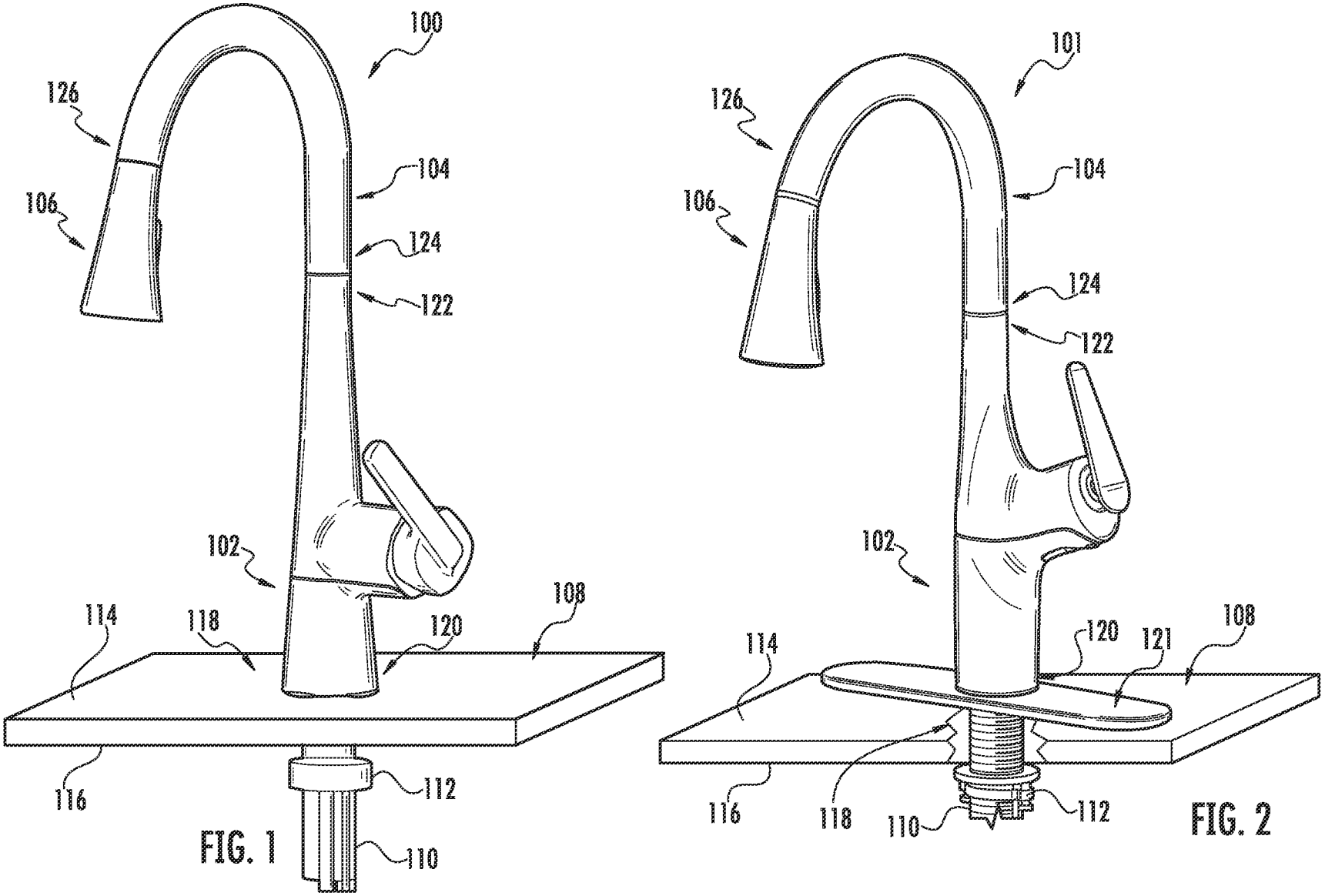
FIG. 1 is a front perspective view of a faucet having an integrated dispensing device, according to an example embodiment.
FIG. 2 is a front perspective view of a faucet having an integrated dispensing device, according to another example embodiment.

Referring now to the figures, FIG. 1 shows a schematic view of a faucet 100. The faucet 100 includes a base 102, a neck 104, and spray head 106. The base 102 may be coupled to a mounting deck 108. The mounting deck 108 may be a countertop in a kitchen or bathroom. In some embodiments, the mounting deck 108 may be part of a handwashing station or some variety of wash basin, such as a bath tub, commercial sink, porcelain sink, bidet, or similar washing basin.

The base 102 may include a shank 110 structured to extend through the mounting deck 108 and receive a deck nut 112. The deck nut 112 may be threaded onto the shank 110 and configured to secure the base 102 to the mounting deck 108. The mounting deck 108 may include a generally planar top deck surface 114, a generally planar bottom deck surface 116, and a deck opening 118, the deck opening 118 extending between the top deck surface 114 and the bottom deck surface 116. The shank 110 extends through the deck opening 118 such that the base 102 interfaces with the top deck surface 114. The deck nut 112 may be threaded onto the shank 110 such that the deck nut 112 interfaces with the bottom deck surface 116, pinching the mounting deck 108 between the base 102 and the deck nut 112, holding the base 102, and thus the faucet 100, in place during regular use. In some embodiments, a washer, spacer, or similar load-distribution structure may be positioned about the shank 110, between the deck nut 112 and the bottom deck surface 116. The washer may evenly disperse the load applied by the deck nut 112 and protect the bottom deck surface 116 from scratches and dents that may be caused by the deck nut 112 during installation of the base 102 and the faucet 100.

As depicted in FIG. 1, faucet 100 may be a single handle kitchen faucet; however, it should be understood that faucet 100 can be any suitable type of faucet, such as, for example, a mechanically operated dual control or single control faucet, a pull-out faucet, a pull-down faucet, or a hands-free, electronic sensor faucet for the kitchen or the lavatory (i.e., wash basin, or tub/shower).

The base 102 includes a first base end 120 proximate to the mounting deck 108 when the faucet 100 is coupled to the mounting deck 108, and a second base end 122 opposite the first base end 120. Coupled proximate to the second base end 122 may be the neck 104. The neck 104 may extend away from the base 102 and away from the mounting deck 108. The neck 104 may be integrally manufactured with the base 102 such that the base 102 and the neck 104 are formed of a single piece. In some embodiments, the neck 104 is separately manufactured from the base 102 and later coupled to the base proximate to the first neck end 124. The neck 104 and the base 102 may be manufactured from metal, plastic, a polymer, metal-plated plastic, or similar materials suitable for use in environments where water, soaps, and solvents are commonly used. In some embodiments, the base 102 and the neck 104 may be formed of a corrosion-resistant material. The neck 104 may include a first neck end 124 and a second neck end 126, opposite the first neck end 124. The first neck end 124 may be coupled to the base 102 proximate to the second base end 122. The second neck end 126 is shown as extending in a direction generally toward the mounting deck 108. Between the first neck end 124 and the second neck end 126, the neck 104 may bend in a J-shape, U-shape, or similarly bent shape. The shape of the neck 104 may be structured based on the intended use of the faucet 100. As shown in FIG. 1, the neck 104 is bent in the shape of a J, offering clearance underneath the neck 104 to complete various activities, such as washing hands, washing dishes, or filling a pot with water. While the neck 104 is shown as a J, it should be understood that the neck 104 may take most any form so long as the neck 104 extends out of the base 102 proximate to the first neck end 124.

The spray head 106 may be positioned proximate to the second neck end 126. In some embodiments, the spray head 106 is coupled to the second neck end 126. In other embodiments, the spray head 106 is fluidly coupled to a retractable hose that extends into the neck 104. The spray head 106 may be removed from the neck 104 and selectively directed to apply a spray of water to a surface within reach of the spray head 106.

Referring now to FIG. 2, a faucet 101 is shown according to an example embodiment. The faucet 101 is similar to the faucet 100. Accordingly, like numbering is used to denote like parts. A difference between the faucet 101 and the faucet 100 is that the faucet 101 has an upturned handle portion 200. The faucet 101 further includes an escutcheon 121. In some embodiments, the escutcheon 121 is configured to extend across a plurality of mounting apertures in the mounting deck 108, such as the mounting apertures provided in a 3-hole or 2-hole sink.

Figure 3:
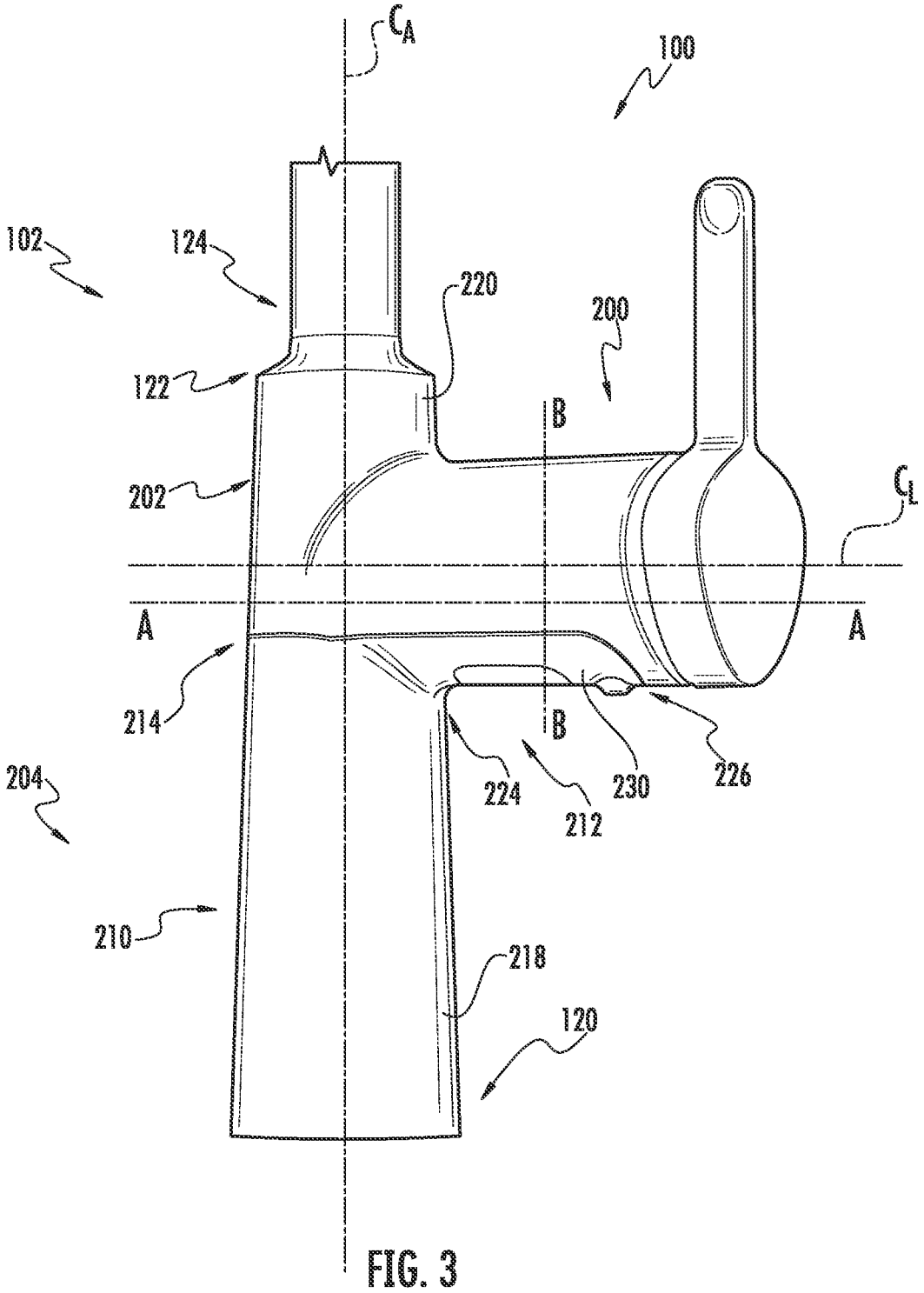
FIG. 3 is a detail view of a portion of the faucet of FIG. 1, according to an example embodiment.

Referring now to FIG. 3, a detailed view of the base 102 is shown. The base 102 includes a handle portion 200, a center shaft 202, and an integrated dispensing device, shown as a dispensing device 204. The center shaft 202 may be centered on a center axis, shown as a center axis $C_A$. The shank 110 may be received within the center shaft 202 such that the center shaft 202 may be fixedly coupled to the mounting deck 108. The handle portion 200 may extend laterally away from the center shaft 202 in a direction generally perpendicular to the center shaft 202 and the center axis $C_A$, the handle portion 200 extending along a handle axis $C_H$. In some embodiments, the handle portion 200 defines a generally cylindrical shape and is integrally formed with the center shaft 202. In some embodiments, the handle portion 200 is formed separately from the center shaft 202 and later coupled to the center shaft 202, such as by welding or fasteners. Generally speaking, the handle portion 200 is structured to receive a portion of the dispensing device 204 such that the handle portion 200 and the portion of the dispensing device 204 form a generally cylindrical cross-section.

The dispensing device 204 includes a dispensing body 210 (e.g., generally annular dispensing body 210) and a lever member, shown as a dispensing arm 212. The dispensing device 204 may be centered about (e.g., centered at) the central axis $C_A$ and may be operable in a plurality of rotational positions. The dispensing device 204 is configured to rotate about the center shaft 202. In some embodiments, the dispensing device 204 may be configured to rotate completely about the center shaft 202 multiple times, spinning either clockwise or counterclockwise an infinite amount of times. In some embodiments, the dispensing device 204 is configured to pivot about the center shaft 202, where "pivot" means the dispensing device is operable between a first position and a second position, the first position and the second position less than 360 rotational degrees relative to each other, and the dispensing device unable to rotate 360 in any single direction. The dispensing arm 212 has a geometry that is complementary to a geometry of the handle portion 200 such that the dispensing arm 212 nests with the handle portion 200 to form a continuous visual surface.

As shown in FIG. 3, the dispensing device 204 is in a dock (e.g., home, nested, first, etc.) position, herein referred to as the first position. When the dispensing device is in the first position, the dispensing arm 212 may be positioned underneath and nest with the handle portion 200. As will be discussed in greater detail, the dispensing device 204 may also be operable in an operating (e.g., use, active, second, etc.) position, herein referred to as the second positon. While the dispensing device 204 may be referred to as being in the first position and the second position, the dispensing device 204 is also operable in a plurality of positions, either between the first position and the second position, or beyond the first position and the second position. As used herein, the first position and the second position are exemplary positions used for explanation purposes, and are not meant to limit the infinite amount of positions made possible by the rotation of the dispensing device 204.

The dispensing body 210 includes a first dispensing end 214, a second dispensing end 216, and an outer dispensing surface 218 (e.g., generally annular outer surface). The outer dispensing surface 218 may define a generally cylindrical profile between the first dispensing end 214 and the second dispensing end 216. Extending through the dispensing body 210 between the first dispensing end 214 and the second dispensing end 216 may be a dispensing orifice 215. The dispensing orifice 215 may be centered on the center axis $C_A$ and configured to accept the center shaft 202 and the shank 110. In some embodiments, the dispensing device 204 is formed of a single piece such that there exists no seam that interrupts the outer dispensing surface 218. The dispensing body 210 is configured to completely surround a portion of the center shaft 202 such that no portion of the center shaft 202 is visible between the dispensing body 210 and the mounting deck 108. The dispensing orifice 215 may further be configured to accept the conduits that deliver water through the neck 104 and to the spray head 106.

Proximate to the first dispensing end 214, the dispensing body 210 may be configured to interface with the center shaft 202. Similar to the dispensing body 210, the center shaft 202 defines an outer shaft surface 220 proximate to the first dispensing end 214 and disposed above the dispensing device 204. The outer shaft surface 220 may define a generally cylindrical profile. To improve the aesthetic appearance of the dispensing device 204 when the dispensing device 204 is in either the first position or the second position, a cross-section of the outer dispensing surface 218 proximate to the first dispensing end 214 may be the same as (e.g., congruent to, etc.) a cross-section of the outer shaft surface 220 proximate to the first dispensing end 214. Thus, when the dispensing device 204 is in the first position, the outer dispensing surface 218 is contiguous with the outer shaft surface 220. In some embodiments, due to machining tolerances, deburring, and finishing, there may exist a slight discontinuity between the outer dispensing surface 218 and the outer shaft surface 220, shown as a separation gap 222. The separation gap 222 may be present whether the dispensing device 204 is in the first position or the second position. In some embodiments, machining and manufacturing of the dispensing device 204 and the center shaft 202 may be precise enough that the separation gap 222 is unable to be seen, or effectively zero.

Referring now to the second dispensing end 216, the dispensing body 210 may interface with the mounting deck 108. In some embodiments, a grease or lubricant is interposed between the second dispensing end 216 and the mounting deck 108 such that the dispensing device 204 may rotate about the center shaft 202 smoothly and without excessive wear to either of the dispensing body 210 or the mounting deck 108. The second dispensing end 216 may define a circular cross-section having a first diameter $D_1$. The first diameter $D_1$ may be greater than a diameter (e.g., major diameter) of the cross-section of the dispensing body 210 proximate to the first dispensing end 214, shown as a second dimeter $D_2$. Thus, the dispensing body 210 may define a frustoconical shape with a very steep outer dispensing surface 218 between the first dispensing end 214 and the second dispensing end 216.

Figure 4:
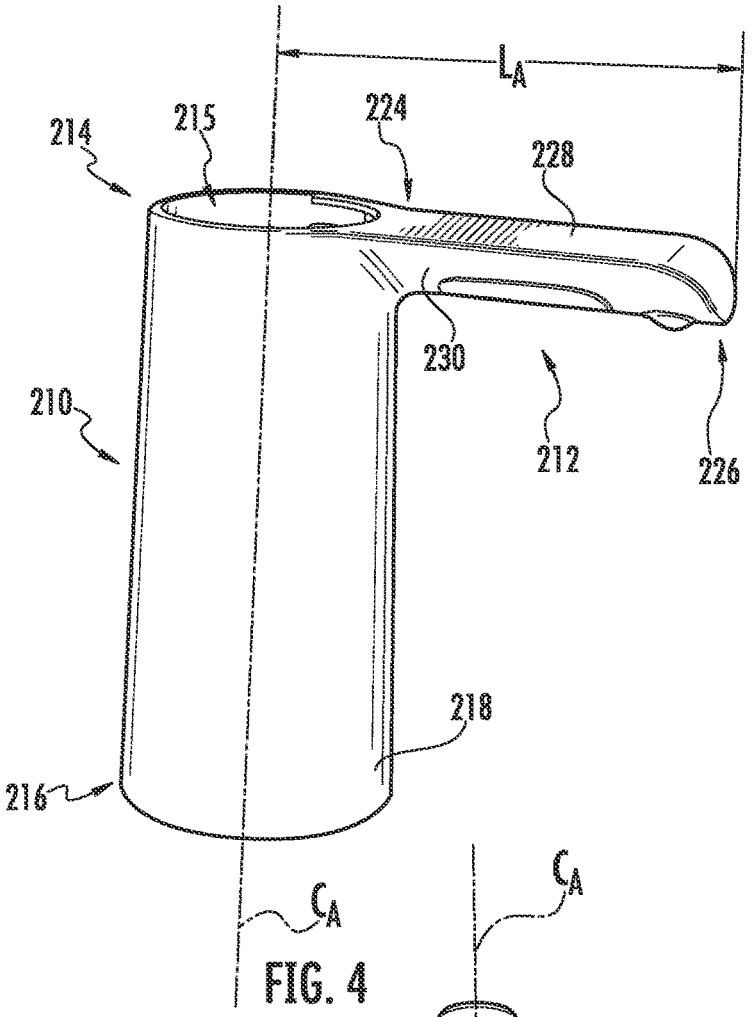
FIG. 4 is a perspective side view of the dispensing device of FIG. 1, according to an example embodiment.

Extending laterally away from the dispensing body 210 proximate to the first dispensing end 214 is the dispensing arm 212. In some embodiments, the dispensing arm 212 extends away from the dispensing body 210 in a direction generally parallel to the handle axis $C_H$, and generally parallel to the handle portion 200. As shown in FIG. 4, the dispensing arm 212 defines a first arm end 224 and a second arm end 226. The first arm end 224 is coupled to the dispensing body 210 proximate to the first dispensing end 214. In some embodiments, the dispensing arm 212 is positioned such that a top surface of the dispensing device 204, shown as a first engagement surface 228 (e.g., planar first surface), is contiguous across both the dispensing body 210 and the dispensing arm 212. The dispensing arm 212 also defines a surface, shown as an outer arm surface 230. The outer arm surface 230 may be contiguous with the outer dispensing surface 218 proximate to the first arm end 224. The dispensing arm 212 further defines an arm length $L_A$, defined as the distance from the second arm end 226 to the center axis $C_A$. In some embodiments, the first engagement surface 228 extends across a top of the 9 dispensing arm 212 for the entirety of the arm length $L_A$.

In some embodiments, the dispensing arm 212 and the dispensing body 210 meet at a corner, such that there exists a discontinuity between the outer dispensing surface 218 and the outer arm surface 230, allowing a user to easily distinguish between the dispensing body 210 and the dispensing arm 212. As shown in FIG. 4, the outer dispensing surface 218 and the outer arm surface 230 are contiguous and continuous, providing a smooth transition between the outer dispensing surface 218 and the outer arm surface 230 so that the dispensing device 204 may be easier to clean, preventing the gathering of dirt and grime.

When the dispensing device 204 is in the first position, the dispensing arm 212 may be positioned below the handle portion 200 such that the first engagement surface 228 interfaces with the handle portion 200.

Figure 5:
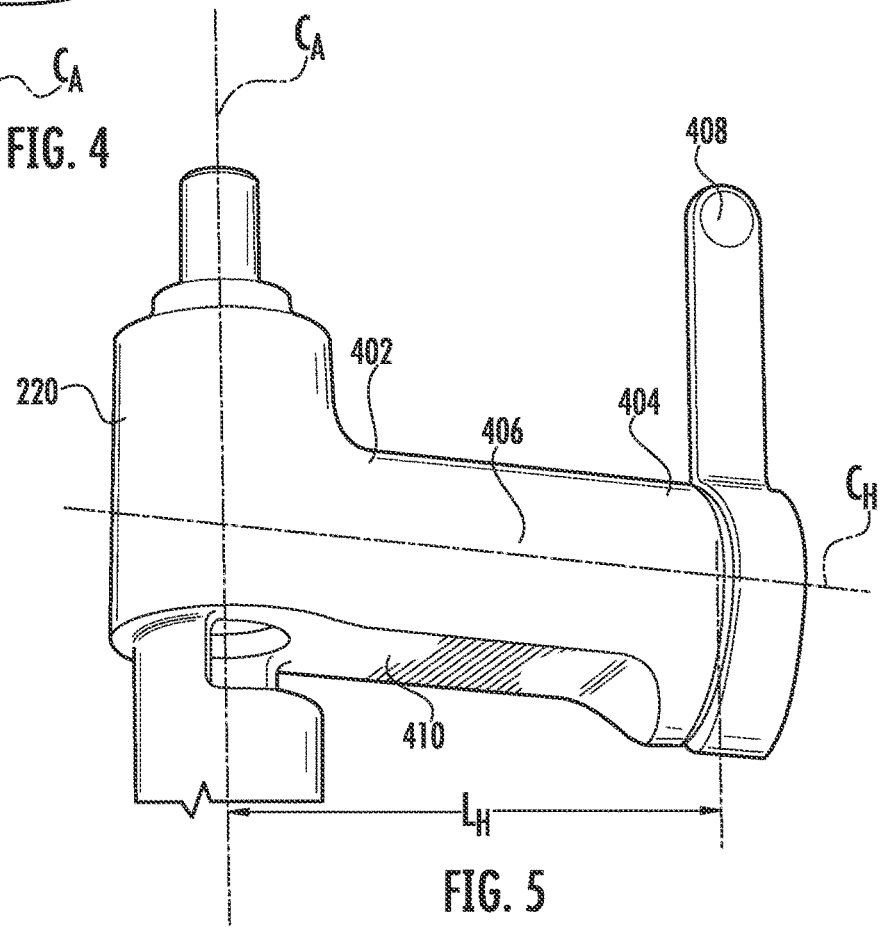
FIG. 5 is a detail cut-away view of a portion of the faucet of FIG. 1, according to an example embodiment.

Referring now to FIG. 5, a detailed perspective view of the handle portion 200 is shown. The handle portion 200 may be integrally formed with the center shaft 202 and extends away from the center shaft 202 along the handle axis $C_H$. In some embodiments, the handle axis $C_H$ is parallel to the central axis $C_A$, and thus the handle portion 200 extends orthogonally away from the center shaft 202. In some embodiments, the handle axis $C_H$ intersects the central axis $C_A$ at an angle other than 90 degrees, such as 80 degrees or 85 degrees. The handle portion 200 defines a first handle end 402, a second handle end 404, and an outer handle surface 406. The handle portion 200 defines a handle length $L_H$, defined as the distance from the second handle end 404 to the center axis $C_A$. In some embodiments, the handle length $L_H$ is greater than the arm length $L_A$. In some embodiments, the handle length $L_H$ and the arm length $L_A$ are the same.

Figure 6:
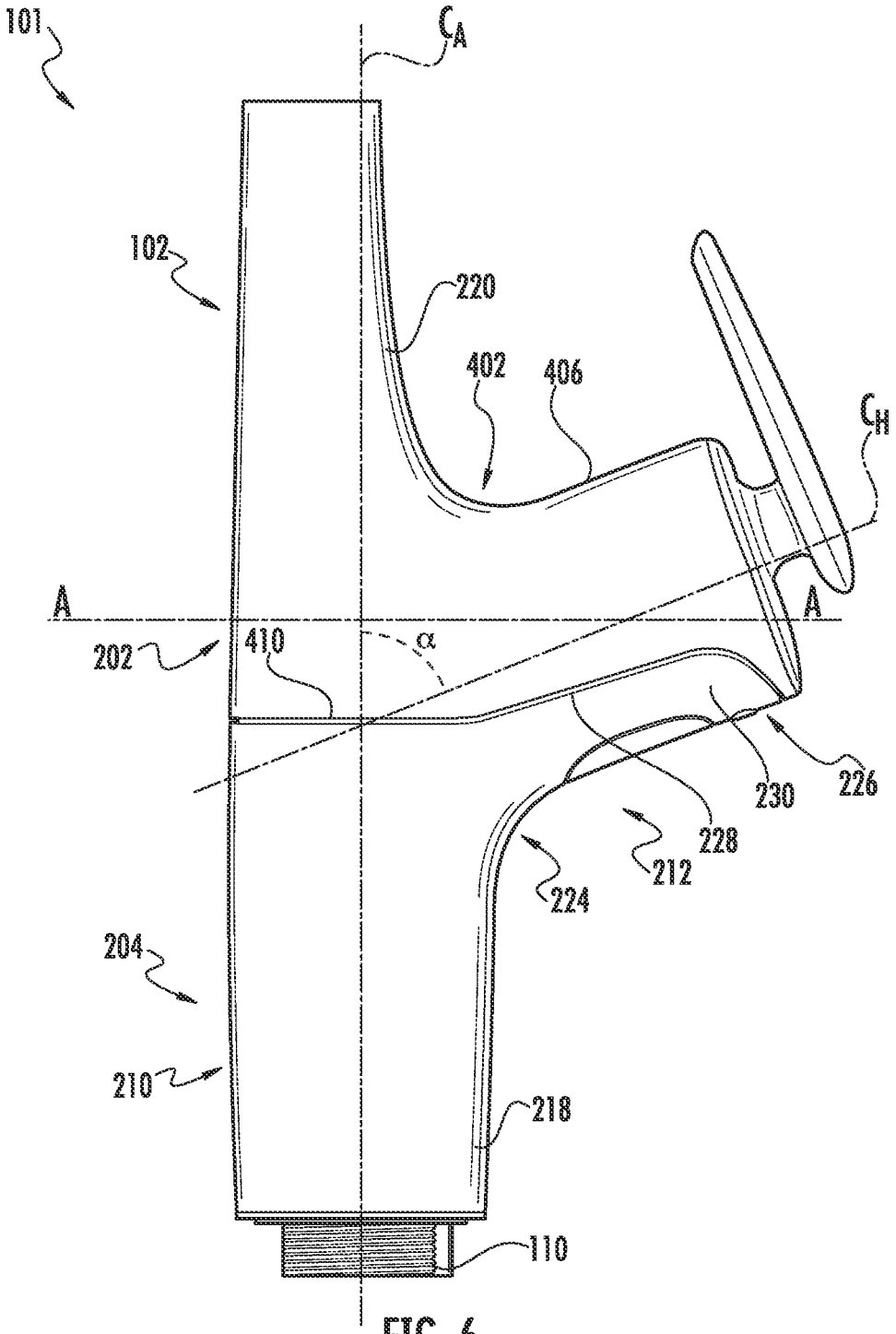
FIG. 6 is a detail view of a portion of the faucet of FIG. 2, according to an example embodiment.

Turning now to FIG. 6, a detailed front view of the upturned handle portion 200 of the faucet 101 of FIG. 2 is shown according to an example embodiment. As shown, the center shaft 202 is not centered on the central axis $C_A$ as the center shaft extends away from the handle portion 200. The center shaft 202 may be offset from (e.g., not centered at) the central axis $C_A$, and the dispensing device 204 may rotate about the central axis $C_A$. The handle portion 200 may extend away from the center shaft 202 along the handle axis $C_H$, where the handle axis $C_H$ forms an angle $\alpha$ with the central axis $C_A$ when viewed from the front. In some embodiments, the angle $\alpha$ may be between 45-90 degrees, inclusive. In some embodiments, the angle $\alpha$ is between 60-80 degrees, inclusive. As shown in FIG. 6, the angle $\alpha$ may be approximately (e.g., within 5% of) 70 degrees. While the central axis $C_A$ and the handle axis $C_H$ appear to intersect with viewed from the front (e.g., when viewed in 2-dimensional space), in some embodiments, the handle axis $C_H$ and the central axis $C_A$ lie in separate planes and do not intersect in 3-dimensional space.

The handle portion 200 is coupled to the center shaft 202 proximate to the first handle end 402. The handle portion 200 may be coupled to the center shaft 202 such that there exists a discontinuity between the outer handle surface 406 and the outer shaft surface 220. In some embodiments, the handle portion 200 and the center shaft 202 are formed such that the outer handle surface 406 and the outer shaft surface 220 are contiguous and continuous. In some embodiments, this may be desirable to ease cleaning of the faucet and to prevent grime and corrosion from occurring between the handle portion 200 and the center shaft 202.

Proximate to the second handle end 404 may be a lever 408. The lever 408 is configured to control a diverter (e.g., set of valves, controls, etc.) disposed within the faucet 100, and in some embodiments disposed within the center shaft 202 and the dispensing body 210. The lever 408 may take many forms, including a knob or a handle.

The handle portion 200 and the center shaft 202 cooperate to define a surface, shown as a second engagement surface 410. The second engagement surface 410 is configured to closely match the first engagement surface 228 such that the second engagement surface 410 does not limit or prevent the rotation of the dispensing device 204. In some embodiments, the second engagement surface 410 and the first engagement surface 228 are configured to interface when the dispensing device 204 is in the first position.

Figure 8:
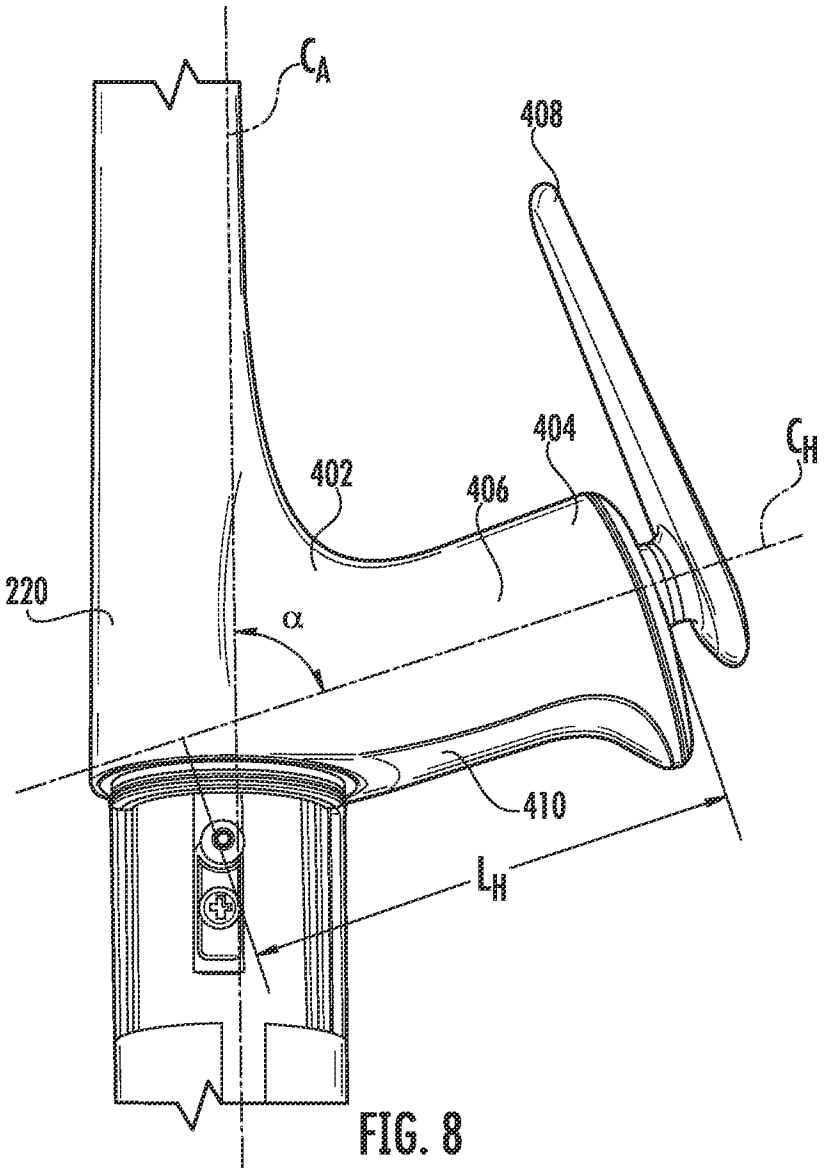
FIG. 8 is a detail cut-away view of a portion of the faucet of FIG. 2, according to an example embodiment.
Figure 7:
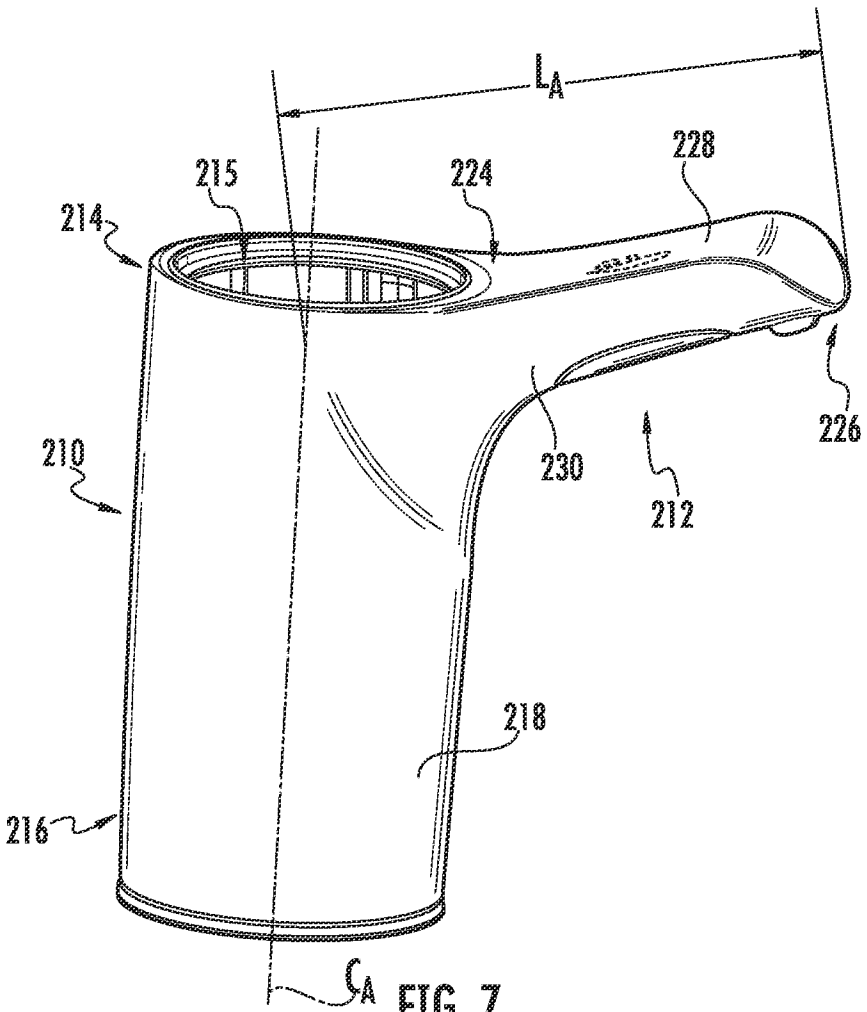
FIG. 7 is a perspective side view of the dispensing device of FIG. 2, according to an example embodiment.

Referring now to FIGS. 7 and 8, the dispensing device 204 and the handle portion 200 of the faucet 101 are shown according to example embodiments. The dispensing device 204 and the handle portion 200 of the faucet 101 are similar to the handle portion 200 and the dispensing device 204 of the faucet 100. Accordingly, like numbering is used to denote like parts. The arm length $L_A$ and the handle length $L_H$ of the faucet 101 are measured along the handle axis $C_H$.

Generally speaking, the dispensing device 204, the center shaft 202, and the handle portion 200 cooperate to produce a contiguous outer surface that masks (e.g., camouflages) the dispensing device 204 when the dispensing device 204 is in the first position.

Specifically, the faucet 100 defines two cross-sections. Referring generally to FIG. 3 and specifically to FIGS. 9 and 10, the faucet defines a first cross-section, taken along plane A and extending between the first base end 120 and the second base end 122; and a second cross-section, taken along plane B extending between the first handle end 402 and the second handle end 404. To achieve the streamlined and out-of-the-way appearance of the dispensing device 204, the first cross-section and the second cross-section may be formed of more than one component.

Figure 9:
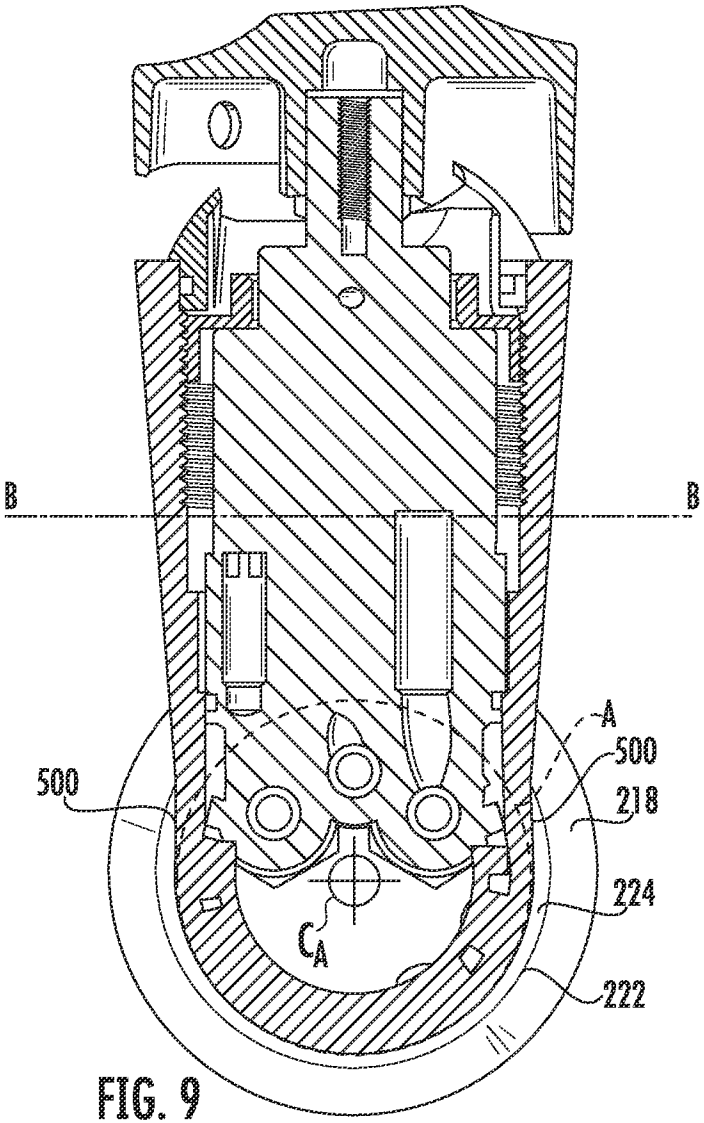
FIG. 9 is a top cross-sectional view of a portion of the faucet of FIG. 1, according to an example embodiment.

Referring now to FIG. 9, a top cross-sectional view of the faucet 100 is shown taken along the plane A. The first cross-section, for the sake of clarity, is shown by the dotted outline A. While plane A extends through the center shaft 202 and handle portion 200, the first cross-section is specifically defined as being the cross-section of the base 102 between the first base end 120 and the second base end 122 shown by the dotted outline A (e.g., the cross-section of the outer shaft surface 220 and the outer dispensing surface 218). Proximate to where the handle portion 200 is coupled to the center shaft 202, there may be some added material caused by injection molding or welding, shown as a filet 500. The filet 500 rounds out the otherwise sharply cornered interface between the handle portion 200 and the center shaft 202. In some embodiments, there is no filet 500.

The outer dispensing surface 218 cooperates with the outer shaft surface 220 to define the first cross-section between the first base end 120 and the second base end 122. Specifically, the first cross-section of the outer shaft surface 220 proximate to the first dispensing end 214 may be congruent to the first cross-section of the outer dispensing surface 218 proximate to the first dispensing end 214. In some embodiments, the first cross-section may define a rounded polygon (e.g., polygon having rounded corners, oval, ellipse, pill, etc.), such as a rounded square, a pentagon, or an ellipse. Thus, if the dispensing device 204 is not in the first position, the first cross-section may suffer a discontinuity proximate to the first dispensing end 214, caused by the rotation of the dispensing device 204 relative to the center shaft 202. In some embodiments, the first cross-section is contiguous between the first base end 120 and the second base end 122 only when the dispensing device 204 is in the first position. In some embodiments, the first cross-section is always contiguous between the first base end 120 and the second base end 122, such as if the first cross-section is circular.

As shown in FIG. 9, interposed between the center shaft 202 and the dispensing body 210 is the separation gap 222. In some embodiments, the machining tolerances are so precise that the separation gap 222 is unable to be seen, and the first engagement surface 228 and the second engagement surface 410 interface with one another. In some embodiments, to allow for smooth rotation of the dispensing body 210, there exists a slight separation between the dispensing body 210 and the center shaft 202. Specifically, there may be a slight separation between the first engagement surface 228 and the second engagement surface 410.

Figure 10:
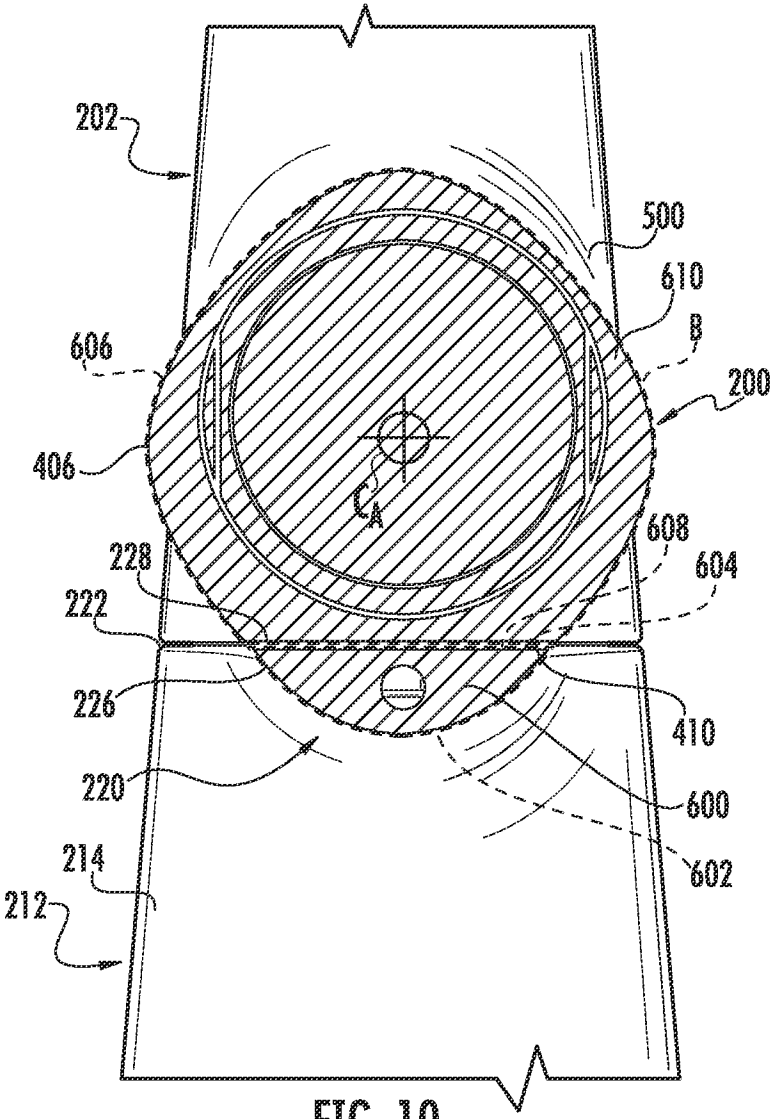
FIG. 10 is a side cross-sectional view of a portion of the faucet of FIG. 1, according to an example embodiment.

Turning to FIG. 10, a side cross-sectional view of the faucet 100 is shown about the plane B of FIG. 9. The second cross-section, for the sake of clarity, is shown by the dotted outline B. The plane B extends through the handle portion 200 and the dispensing arm 212. Proximate to where the handle portion 200 is coupled to the center shaft 202 may be the filet 500.

Generally speaking, when the dispensing device 204 is in the first position, the outer arm surface 230 and the outer handle surface 406 cooperate to define the second cross-section. The second cross-section may be defined as a second shape (e.g., polygon, rounded polygon) having a second perimeter without discontinuities. For example, the second shape may be a circle, an ellipse, a rounded square, an octagon, or a similar shape. The first engagement surface 228 and the outer arm surface 230 cooperate to define a portion of the second shape, shown as a first segment 600. The first segment 600 defines a first segment perimeter. Generally speaking, in geometry, a "segment" refers to a portion of a circle bound by a "chord" and an "arc."

As used herein, an "arc" is defined as a portion of a perimeter of a rounded polygon. As used herein, a "chord" is defined as a line segment whose endpoints lie on the perimeter of a rounded polygon, but a chord may not extend through the perimeter of the rounded polygon. For example, for a rounded polygon having acute internal angles (e.g., a star), a "chord" as defined herein, may not extend through the perimeter of the rounded polygon (e.g., exit the rounded polygon, and re-enter the rounded polygon, effectively separating the rounded polygon into three or more pieces). While either the first cross-section or the second cross-section my define a star or other polygon having acute internal angles, a "chord," as used herein, maintains a limited definition.

As used herein, a "segment" refers to a portion of a rounded polygon bound by a "chord" and an "arc."

Referring again to FIG. 10, and specifically to the dispensing arm 212, the outer arm surface 230 defines a first arc 602 of the second shape, and the first engagement surface 228 defines a first chord 604 of the second shape. The first arc 602 and the first chord 604 cooperate to define the first segment 600. Referring now to the handle portion 200, the outer handle surface 406 defines a second arc 606 of the second shape, and the second engagement surface 410 defines a second chord 608 of the second shape. The second arc 606 and the second chord 608 cooperate to define a second segment 610 of the second shape.

When the dispensing device 204 is in the first position, the first arc 602 and the second arc 606 may align such that the second perimeter is contiguous and contains no discontinuities. In some embodiments, the separation gap 222 creates a discontinuity between the first arc 602 and the second arc 606. Thus, in some embodiments, the first arc 602 and the second arc 606 may cooperate to define 95% of the second perimeter. In some embodiments, the first arc 602 and the second arc 606 may cooperate to define 97% of the second perimeter. In some embodiments, the first arc 602 and the second arc 606 may cooperate to define 99% of the second perimeter.

As a result of the separation of the first engagement surface 228 and the second engagement surface 410, the second chord 608 may define a length slightly greater than (e.g., 5% greater than, 3% greater than, less than 1% greater than, etc.) a length of the first chord 604. In some embodiments, the first chord 604 and the second chord 608 may have equal lengths.

Figure 11:
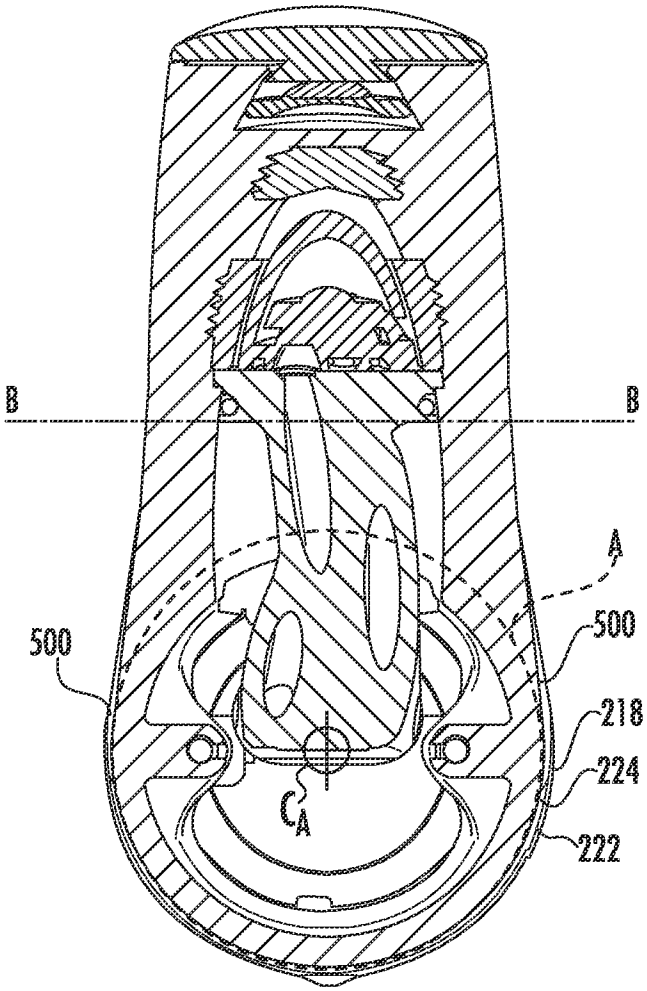
FIG. 11 is a top cross-sectional view of a portion of the faucet of FIG. 2, according to an example embodiment.

In some embodiments, the second cross-section, and thus the second shape, may change between the first handle end 402 and the second handle end 404. For example, as shown in FIG. 9, the handle portion 200 tappers outward as the handle portion 200 extends away from the center shaft 202. In some embodiments, as shown in FIG. 11, the handle portion 200 tappers inward (e.g., toward the handle axis $C_H$) as the handle portion 200 extends away from the center shaft 202. In some embodiments, the second shape is congruent between the first handle end 402 and the second handle end 404.

Proximate to the second handle end 404, the dispensing arm 212 may no longer cooperate with the handle portion 200 to define the second shape. As shown in FIG. 3, the dispensing arm 212 may tapper off before extending to the second handle end 404 (e.g., the arm length $L_A$ is less than the handle length $L_H$). Thus, the second arc 606 proximate to the second handle end 404 may define the entirety of the perimeter of the second shape, and the second segment 610 may define the entirety of the second cross-section and the second shape.

While many ratios between the first segment 600 and the second segment 610 are possible, in some embodiments it may be desirable for the first segment 600 to define less than 40% of the second shape, and for the first arc 602 to define less than 40% of the second perimeter. In some embodiments, the first segment 600 defines less than 30% of the second shape, and the first arc 602 defines less than 30% of the second perimeter. However, the first arc 602 and the second arc 606 cooperate to form between 95% and 100% of the second perimeter, and may cooperate to create the second perimeter having no discontinuities.

Figure 12:
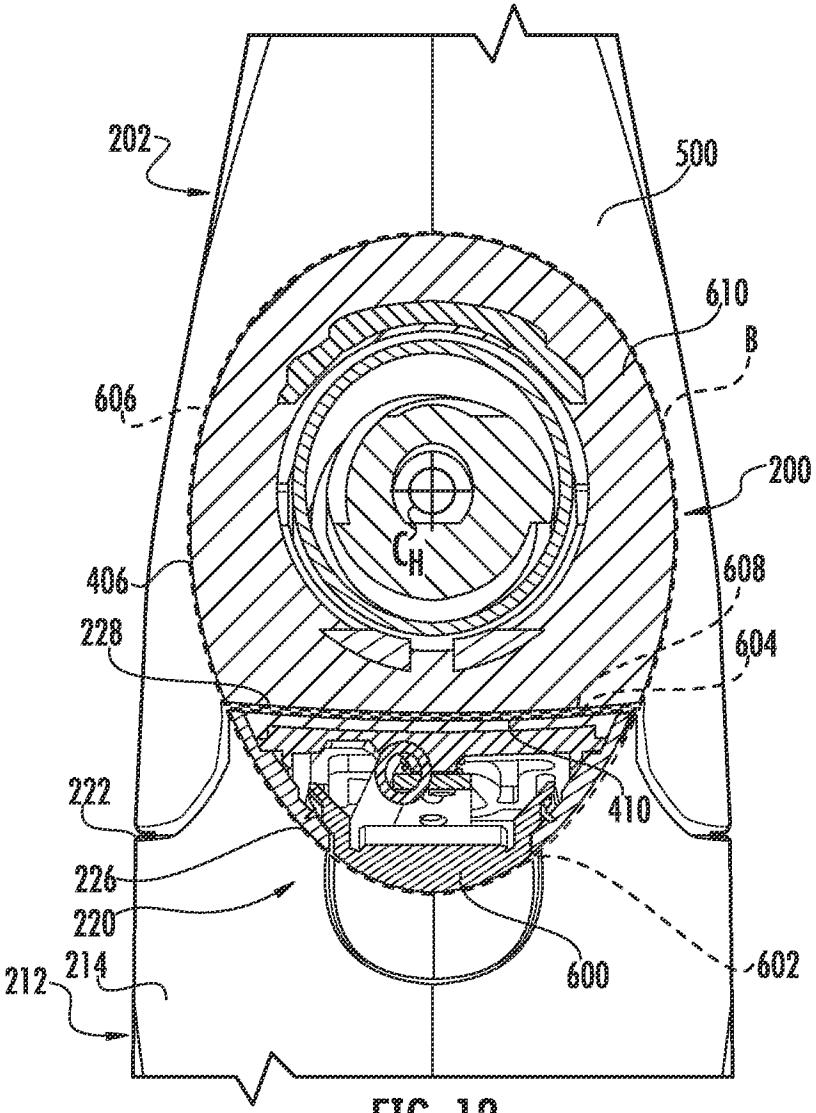
FIG. 12 is a side cross-sectional view of a portion of the faucet of FIG. 2, according to an example embodiment.

Referring now to FIG. 11, a top cross-sectional view of the handle portion 200 of the faucet 101 is shown, according to an example embodiment. The handle portion 200 tapers to a smaller cross-section as the handle portion 200 extends away from the base 102. Referring to FIG. 12, a side cross-section of the handle portion 200 is shown according to an example embodiment. The first arc 602 and the second arc 606 cooperate to define a substantially egg-shaped cross-section.

Figure 13:
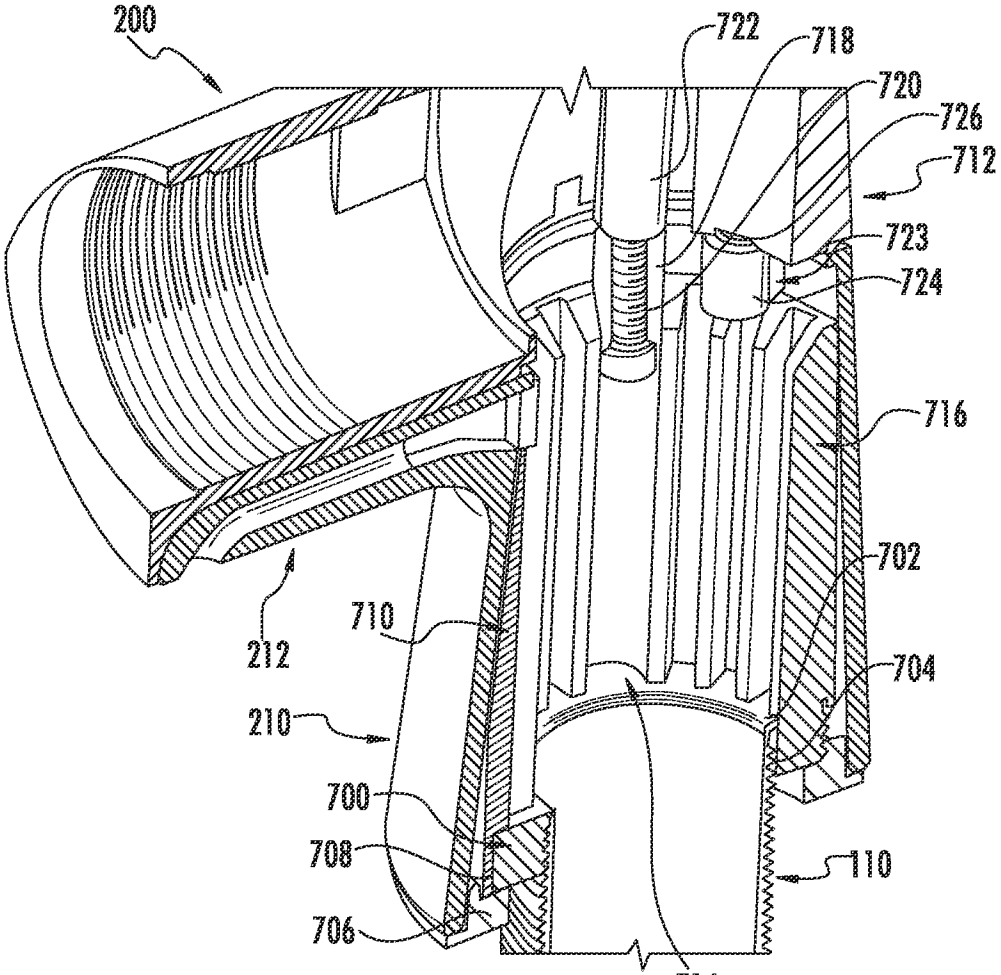
FIG. 13 is a perspective cross-sectional view of a portion of the faucet of FIG. 1, according to an example embodiment.

Referring now to FIG. 13, a perspective cross-sectional view of a portion of the base 102 is shown, including a portion of the handle portion 200, the dispensing device 204, the center shaft 202, and the shank 110.

Extending into the dispensing body 210 are the center shaft 202 and the shank 110. Proximate to the second dispensing end 216, the shank 110 is coupled to an annular body, shown as a lock nut 700. The lock nut 700 may include threads and form a threaded connection with the shank 110. The lock nut 700 may include a flange extending laterally inward (e.g., toward the center axis $C_A$), shown as a nut flange 702. The nut flange 702 may interface with a top of the shank 110 to facilitate the engagement of the lock nut 700 with the shank 110. When the deck nut 112 is threaded to the shank 110, the force of the deck nut 112 on the underside of the mounting deck 108 may pull the lock nut 700 toward the mounting deck 108. In some embodiments, positioned around the shank 110 and configured to interface with the lock nut 700 may be a annular body, shown as a ring 706. The ring 706 may be formed of an elastomer such that the ring 706 may form a seal (e.g., a watertight seal) between the mounting deck 108 and the lock nut 700. In some embodiments, when the deck nut 112 is threaded onto the shank 110, the force of the deck nut 112 pulls the lock nut 700 into the ring 706 and pinches the ring 706 between the mounting deck 108 and the lock nut 700.

In some embodiments, the lock nut 700 may include internal threads 704, configured to form a threaded connection with the shank 110, and external threads 708, configured to couple to the center shaft 202. In some embodiments, the lock nut 700 is coupled to the center shaft 202 by adhesive, latches, welding, fasteners, or other coupling and fastening means.

As shown in FIG. 13, the center shaft 202 includes a first portion 710 disposed within the dispensing body 210, and a second portion 712 positioned above the dispensing body 210 and coupled to the handle portion 200. The first portion 710 defines a generally annular body centered on the center axis $C_A$. In some embodiments, conduits are configured to extend through the shank 110 and through the faucet 100 to deliver a flow of water to the spray head 106. Thus, the first portion 710 may define an opening 714 which extends through the entirety of the first portion 710. The first portion 710 may also include a support structure, shown as a plurality of supports 716. The plurality of supports 716 may extend between the ends of the first portion and extend into the opening 714. In some embodiments, the plurality of supports 716 interface with the lock nut 700 proximate to the shank 110. To facilitate rotation of the dispensing device 204 about the center axis $C_A$, the first portion 710 may interface with the dispensing device 204 while the dispensing device 204 is in the first position, the second position, and transitioning between the first position and the second positon. In some embodiments, the first portion 710 is spaced apart from the dispensing body 210 such that the first portion 710 does not interface with the dispensing body 210.

When the faucet 100 is installed in (e.g., mounted to) the mounting deck 108, the first portion 710 may be fixedly coupled such that a tool (e.g., wrench) or excessive force (e.g., force beyond double what is to be expected under normal use conditions) is required to rotate the first portion relative to the mounting deck 108.

The first portion 710 may further include a first fixture 718 configured to accept a fastener 720. The fastener 720 may extend through the first fixture 718 such that a head of the fastener 720 (e.g., washer, etc.) may extend in a direction generally toward the lock nut 700. The fastener 720 may extend through the first fixture 718 and into a second fixture 722 defined by the second portion 712. In some embodiments, the second fixture 722 may be threaded and accept a threaded fastener (e.g., the fastener 720). When the shank 110 is secured to the mounting deck 108 via the deck nut 112, the second portion 712 may be fixedly coupled such that rotation of the second portion 712 requires a tool or excessive force. As outlined above with respect to the center shaft 202, the outer shaft surface 220 is specifically disposed on the second portion 712, forming the contiguous outer surface along the outer dispensing surface 218 and the outer shaft surface 220. As also outlined above, notice that the second portion 712 defines the first cross-section. While the second portion 712 and the handle portion 200 are shown as a single, integrated piece, the second portion 712 specifically refers to the portion having the first cross-section.

The first fixture 718 and the second fixture 722 may be structured such that when the first portion 710 and the second portion 712 are coupled together, the dispensing device 204 is still free to rotate about the center axis $C_A$. In some embodiments, the dispensing device 204 includes bearings positioned proximate to the first dispensing end 214 and the second dispensing end 216 to facilitate rotation of the dispensing device 204. The faucet 100 may be manufactured much like the headset of a bicycle (or similar loose-bearing assemblies). The first portion 710 may be coupled to the second portion 712 such that the ring 706 is pulled toward the second portion 712, thus pinching the dispensing device 204 between the ring 706 and the second portion 712. The fastener 720 may be tightened enough to prevent play (e.g., translational movement) between the dispensing device 204 and the center shaft 202, but not so tight that the dispensing device 204 is pinched and unable to rotate due to friction between the second portion 712 and the ring 706.

Figure 14:
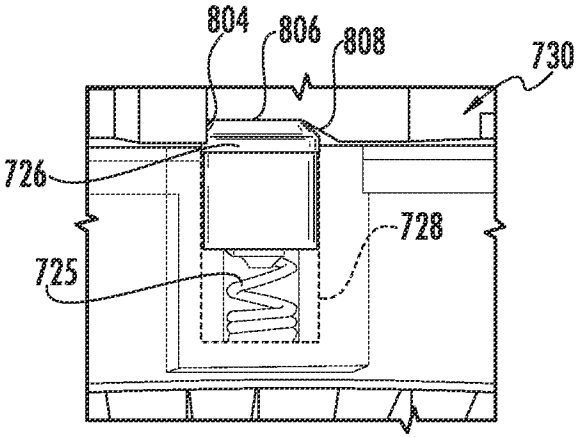
FIG. 14 is a detail view of the portion of FIG. 7, according to an example embodiment.

The dispensing device 204 may further includes a detent 723 configured to facilitate rotation of the dispensing device 204 between the first position and the second position. Shown in FIG. 14 is the detent 723, which includes a detent fixture 724, an actuating member shown as a spring 725, and a knob 726. The detent 723 is configured to interface with the second portion 712 to facilitate the transition of the dispensing body 210 between the first position and the second position. The detent fixture 724 may be integrally formed with the dispensing body 210, such as by milling or molding. The detent fixture 724 projects laterally inward from the dispensing body 210 in a direction generally toward the center axis $C_A$. The detent fixture 724 defines an internal cavity, shown by hidden lines as a detent cavity 728. Within the detent cavity 728 are positioned the spring 725 and the knob 726. The spring 725 is configured to bias the knob 726 upward in a direction generally toward the second portion 712, the spring 725 configured to selectively bias the knob 726 out of the detent fixture 724 such that the knob 726 may interface with the second portion 712. Specifically, the second portion 712 includes a curved surface, shown as a detent flange 730, positioned within the second portion 712 and extending along an arc of the second portion 712.

Figure 15:
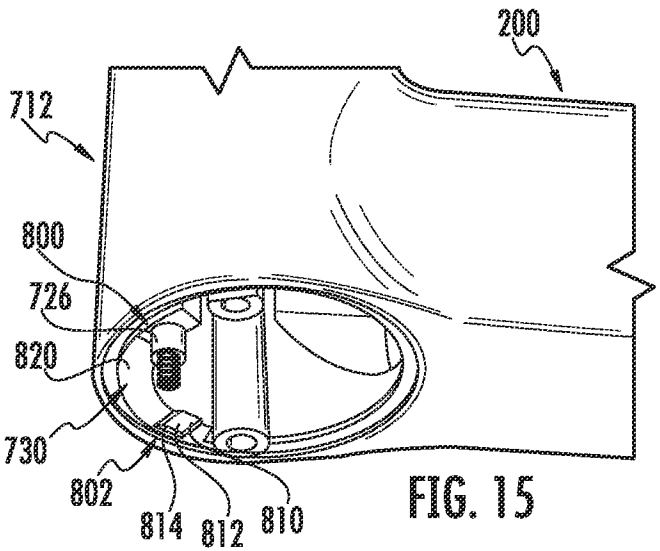
FIG. 15 is a perspective detail view of a portion of the faucet of FIG. 1, according to an example embodiment.

As shown in FIG. 15, the detent flange 730 includes a first detent cavity 800 and a second detent cavity 802. The first detent cavity 800 is defined by a plurality of surfaces, shown as a first stop 804, a first rest 806, and a first ramp 808. Similar to the first detent cavity 800 is the second detent cavity 802, defined by a plurality of surfaces, shown as a second stop 810, a second rest 812, and a second ramp 814.

The knob 726 is configure to interface with the detent flange 730, the first detent cavity 800, and the second detent cavity 802 to facilitate the transition of the dispensing device 204 between the first position and the second positon. Specifically, when the dispensing device 204 is in the first position, the knob 726 is disposed within the first detent cavity 800 and interfaces with the first rest 806 and, in some embodiments, the first stop 804. When a user of the dispensing device 204 desires the transition the dispensing device 204 out of the first position, the user may apply a force to the dispensing arm 212 in a direction toward the second position. Relative to FIG. 13, the user may apply a lateral force to the dispensing arm 212 in a direction clockwise about the center axis $C_A$. When the force is applied, the knob 726 will transition toward the first ramp 808, the first ramp 808 biasing the knob 726 in to the detent fixture 724 as the detent 723 moves. Once the knob 726 is past the first ramp 808, the knob 726 will interface with a generally planar surface of the detent flange 730 that extends between the first detent cavity 800 and the second detent cavity 802, shown as a detent surface 820.

In some embodiments, the user may stop applying the force to the dispensing device 204, positioning the detent 723 between the first detent cavity 800 and the second detent cavity 802. In some embodiments, the user may continue to apply the rotational force to the dispensing device 204, the knob 726 interfacing with the detent surface 820 as a result of the spring 725 biasing the knob 726 into the detent flange 730. Eventually, the knob 726 will reach the second ramp 814 of the second detent cavity 802. The spring 725 will bias the knob 726 into the second ramp 814 and eventually into the second rest 812 as the detent 723 continues to rotate toward the second position. The knob 726 may there interface with the second stop 810 configured to prevent further rotation of the dispensing device 204 away from the first position. At this point, the dispensing device 204 is in the second position.

In some embodiments, the detent flange 730 may include a third detent cavity, positioned beyond the second detent cavity 802, such that the dispensing device 204 may be operable between a first position, a second position, and a third position. In such embodiments, it may be desirable for the second detent cavity 802 to include two ramps (e.g., the second ramp 814) such that the knob 726 may be translated either clockwise or counterclockwise away from the second detent cavity 802. In some embodiments, the detent flange 730 and the detent surface 820 extend about the entire perimeter of the second portion 712 proximate to the first dispensing end 214 such that the dispensing device may be rotated over 360 rotational degrees in any one direction. However, it may be desirable in some embodiments, to prevent the rotation of the dispensing device 204 360-degrees in any one direction such as by use of the first detent cavity 800 and the second detent cavity 802 such that the conduits disposed within the dispensing device 204 do not get tangled.

Figure 16:
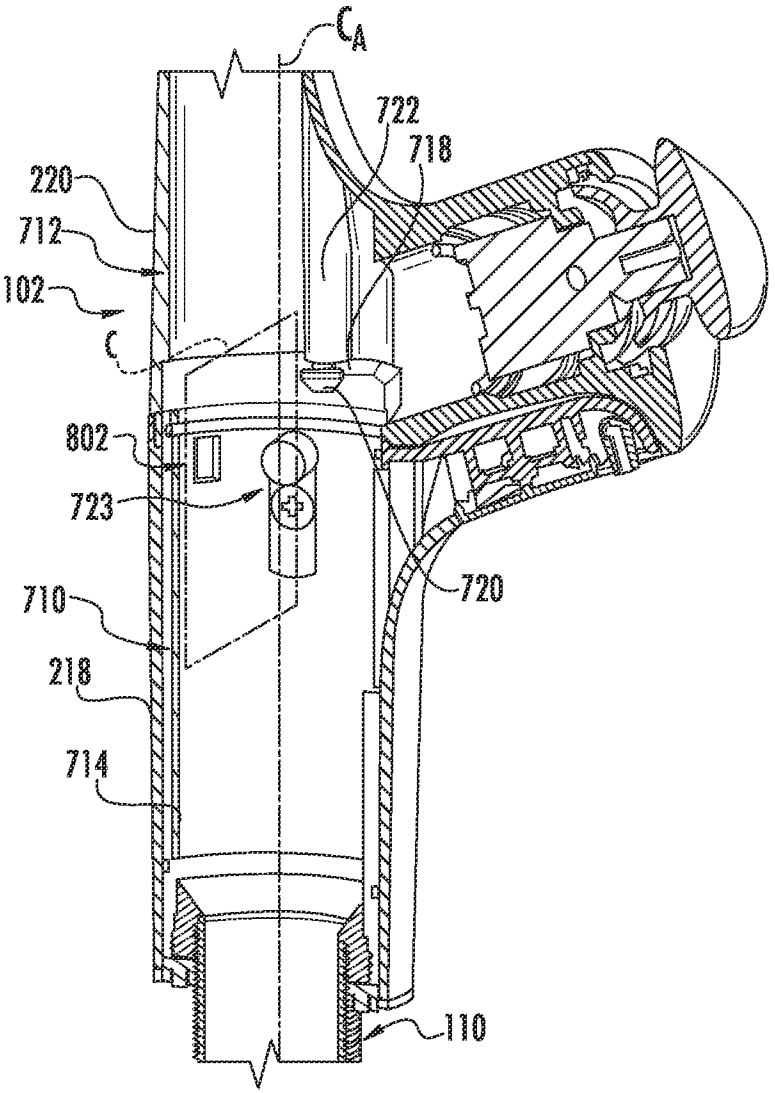
FIG. 16 is a perspective cross-sectional view of a portion of the faucet of FIG. 5, according to an example embodiment.

Referring now to FIG. 16, a perspective cross-sectional view of a portion of the base 102 is shown according to an example embodiment, including a portion of the handle portion 200, the dispensing device 204, the center shaft 202, and the shank 110. The portion of the base 102 in FIG. 16 is similar to the portion of the base 102 shown in FIG. 13. Accordingly, like numbering is used to designate like parts between the portion of the base 102 of FIG. 13 and the portion of the base 102 of FIG. 16.

Extending into the dispensing body 210 are the center shaft 202 and the shank 110. The center shaft 202 includes a first portion 710 (shown as being transparent in FIG. 16) and a second portion 712. The first portion 710 is positioned within the dispensing body 210, the first portion 710 having a portion that extends out of the dispensing body 210. The second portion 712 is coupled to the first portion 710 opposite the shank 110.

The first portion 710 defines a generally annular body centered on the center axis $C_A$. In some embodiments, conduits are configured to extend through the shank 110 and through the faucet 100 to deliver a flow of water to the spray head 106. Thus, the first portion 710 may define an opening 714 which extends through the entirety of the first portion 710. To facilitate rotation of the dispensing device 204 about the center axis $C_A$, the first portion 710 may interface with the dispensing device 204 while the dispensing device 204 is in the first position, the second position, and transitioning between the first position and the second positon. In some embodiments, the first portion 710 is spaced apart from the dispensing body 210 such that the first portion 710 does not interface with the dispensing body 210.

When the faucet 100 is installed in (e.g., mounted to) the mounting deck 108, the first portion 710 may be fixedly coupled such that a tool (e.g., wrench) or excessive force (e.g., force beyond double what is to be expected under normal use conditions) is required to rotate the first portion relative to the mounting deck 108.

The first portion 710 may further include a first fixture 718 configured to accept a fastener 720. The fastener 720 may extend through the first fixture 718 such that a head of the fastener 720 (e.g., washer, etc.) may extend in a direction generally toward the shank 110. The fastener 720 may extend through the first fixture 718 and into a second fixture 722 defined by the second portion 712. In some embodiments, the second fixture 722 may be threaded and accept a threaded fastener (e.g., the fastener 720). When the shank 110 is secured to the mounting deck 108 via the deck nut 112, the second portion 712 may be fixedly coupled such that rotation of the second portion 712 requires a tool or excessive force. The first fixture 718 and the second fixture 722 may be structured such that when the first portion 710 and the second portion 712 are coupled together, the dispensing device 204 is still free to rotate about the center axis $C_A$. As outlined above with respect to the center shaft 202, the outer shaft surface 220 is specifically disposed on the second portion 712, forming the contiguous outer surface along the outer dispensing surface 218 and the outer shaft surface 220. As also outlined above, notice that the second portion 712 defines the first cross-section. While the second portion 712 and the handle portion 200 are shown as a single, integrated piece, the second portion 712 specifically refers to the portion having the first cross-section.

Figure 17:
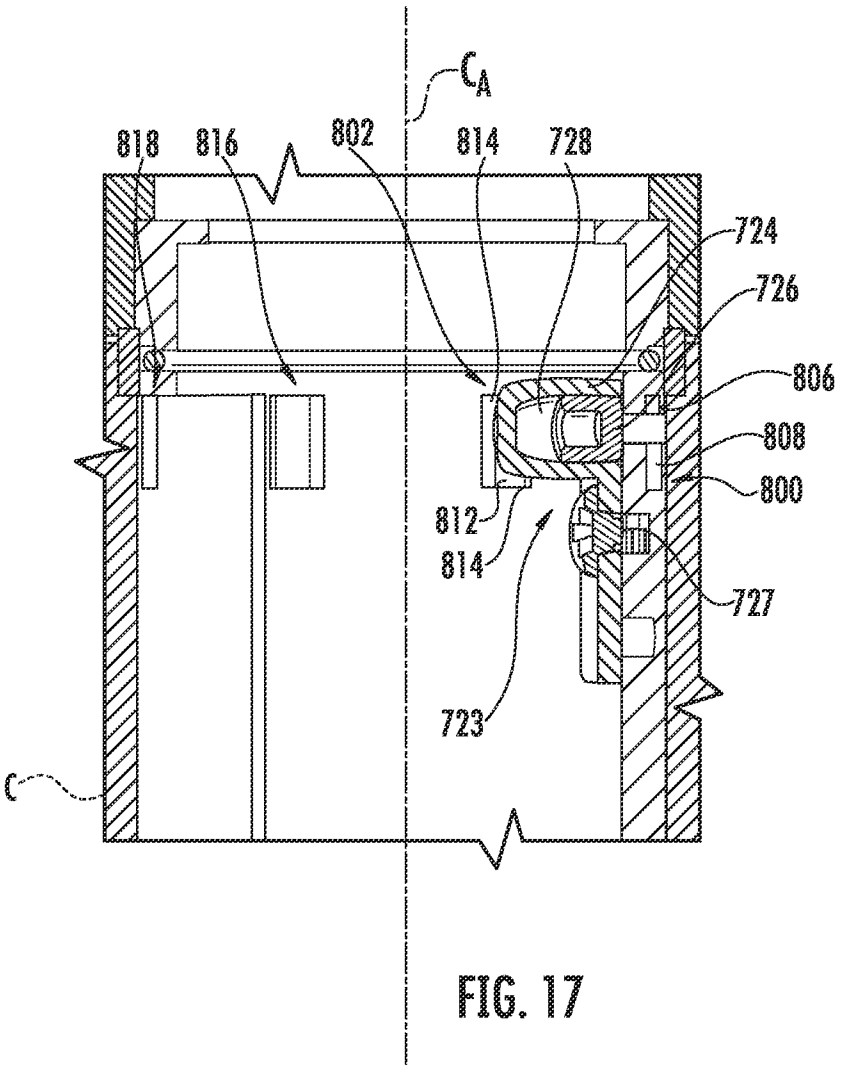
FIG. 17 is a detail cross-section view of a portion of the faucet of FIG. 11, according to an example embodiment.

The dispensing device 204 may further includes a detent 723 configured to facilitate rotation of the dispensing device 204 between the first position and the second position. FIG. 17 shows a detailed cross-sectional view of a portion C of the dispensing device shown in FIG. 16. The detent 723 is shown as including a detent fixture 724, a fastener 727, and a knob 726. The detent 723 is configured to interface with the dispensing body 210 to facilitate the transition of the dispensing device 204 between the first position and the second position. The detent fixture 724 may be integrally formed with the first portion 710, such as by milling or molding. In some embodiments, the detent fixture 724 is coupled to the first portion 710 with the fastener 727. The detent fixture 724 projects laterally inward from the first portion 710 in a direction generally toward the center axis $C_A$. The detent fixture 724 defines an internal cavity, shown as a detent cavity 728. Within the detent cavity 728 is positioned the knob 726. In some embodiments, a biasing member may be positioned within the detent cavity 728, such as a spring, configured to bias the knob 726 in a direction generally toward the dispensing body 210 and away from the central axis $C_A$. In some embodiments, the compliance of the knob 726 and the sloping walls of the detent cavity 728 cooperate to bias the knob 726 toward the dispensing body 210. The knob 726 interfaces with the dispensing body 210 and selectively cooperates with the dispensing body 210 to inhibit rotation of the dispensing device relative to the center shaft 202.

Specifically, the dispensing body 210 may include a first detent cavity 800 and a second detent cavity 802. The first detent cavity 800 includes a first rest 806 and a first ramp 808. Similar to the first detent cavity 800 is the second detent cavity 802, defined by a plurality of surfaces, shown as a second rest 812 and a second ramp 814.

The knob 726 is configure to interface with the first detent cavity 800 and the second detent cavity 802 to facilitate the transition of the dispensing device 204 between the first position and the second positon. Specifically, when the dispensing device 204 is in the first position, the knob 726 is disposed within the first detent cavity 800 and interfaces with the first rest 806. When a user of the dispensing device 204 desires the transition the dispensing device 204 out of the first position, the user may apply a force to the dispensing arm 212 in a direction toward the second position. Relative to FIG. 16, the user may apply a lateral force to the dispensing arm 212 in a direction clockwise about the center axis $C_A$. When the force is applied, the first detent cavity 800 will begin to shift clockwise relative to the knob 726. The knob 726 will transition toward the first ramp 808, the first ramp 808 biasing the knob 726 into the detent fixture 724 (e.g., toward the central axis $C_A$) as the detent 723 moves. Once the knob 726 is past the first ramp 808, the knob 726 will interface with an inner surface of the dispensing body 210. Since the detent 723 is coupled to the first portion 710, the detent 723 remains rigid as the dispensing body 210 is rotated about the center shaft 202.

In some embodiments, the user may stop applying the force to the dispensing device 204, positioning the detent 723 between the first detent cavity 800 and the second detent cavity 802. In some embodiments, the user may continue to apply the rotational force to the dispensing device 204 until the knob 726 interfaces with the second ramp 814 of the second detent cavity 802. The knob 726 is biased into the second ramp 814 and eventually into the second rest 812 as the detent 723 continues to rotate toward the second position. At this point, the dispensing device 204 is in the second position.

In some embodiments, the detent flange 730 may include a third detent cavity 816 and a fourth detent cavity 818, positioned beyond the second detent cavity 802, such that the dispensing device 204 may be operable between a first position, a second position, a third position, and a fourth position. In such embodiments, it may be desirable for the second detent cavity 802 to include two ramps (e.g., the second ramp 814) such that the knob 726 may be translated either clockwise or counterclockwise away from the second detent cavity 802. In some embodiments, the dispensing body 210 may include a plurality of detent cavities profiled about an inner circumference of the inner surface such that the dispensing device 204 may be rotated over 360 rotational degrees in any one direction. However, it may be desirable in some embodiments, to prevent the rotation of the dispensing device 204 360-degrees in any one direction such as by use of stops, preventing the conduits disposed within the dispensing device 204 from getting tangled.

Figure 18:
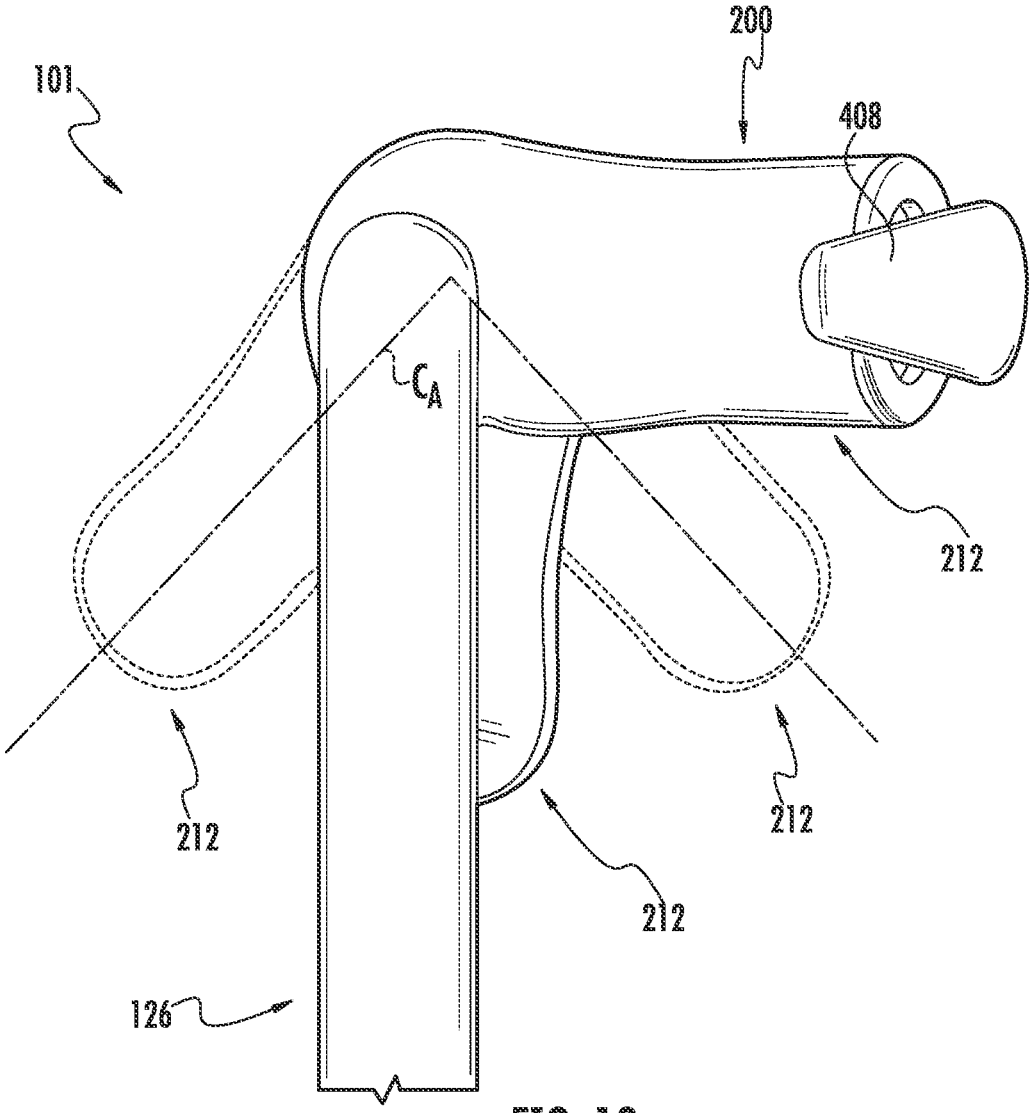
FIG. 18 is a top view of the faucet of FIG. 2, according to an example embodiment.

Referring now to FIG. 18, a top view of the faucet 101 is shown. The dispensing device 204 is shown in four different positions. When the dispensing device 204 is in the first position, the dispensing arm 212 abuts the handle portion 200 and is hidden from view when viewed from above. The dispensing device 204 is rotatable about the central axis $C_A$ such that the dispensing arm 212 may extend away from the base 102 in a direction that is different from the direction that the handle portion 200 extends away from the base 102. As viewed in FIG. 18, the dispensing device 204 may be rotated from the first position to the second position in a clockwise direction about the central axis $C_A$. In some embodiments, the detent 723 facilitates positioning of the dispensing arm 212 in the first position, the second position 45 degrees clockwise about the central axis $C_A$ relative to the first position, a third position 90 degrees clockwise about the central axis $C_A$ relative to the first position, and a fourth position 135 degrees clockwise about the central axis $C_A$ relative to the first position. In some embodiments, the faucet 101 includes a hard stop that prevents the dispensing device 204 from rotating further clockwise than the fourth position. In some embodiments, the dispensing device 204 is continuously rotatable about the central axis $C_A$ such that the dispensing device 204 may rotate about the central axis $C_A$ multiple times in the same rotational direction.

Figure 19:
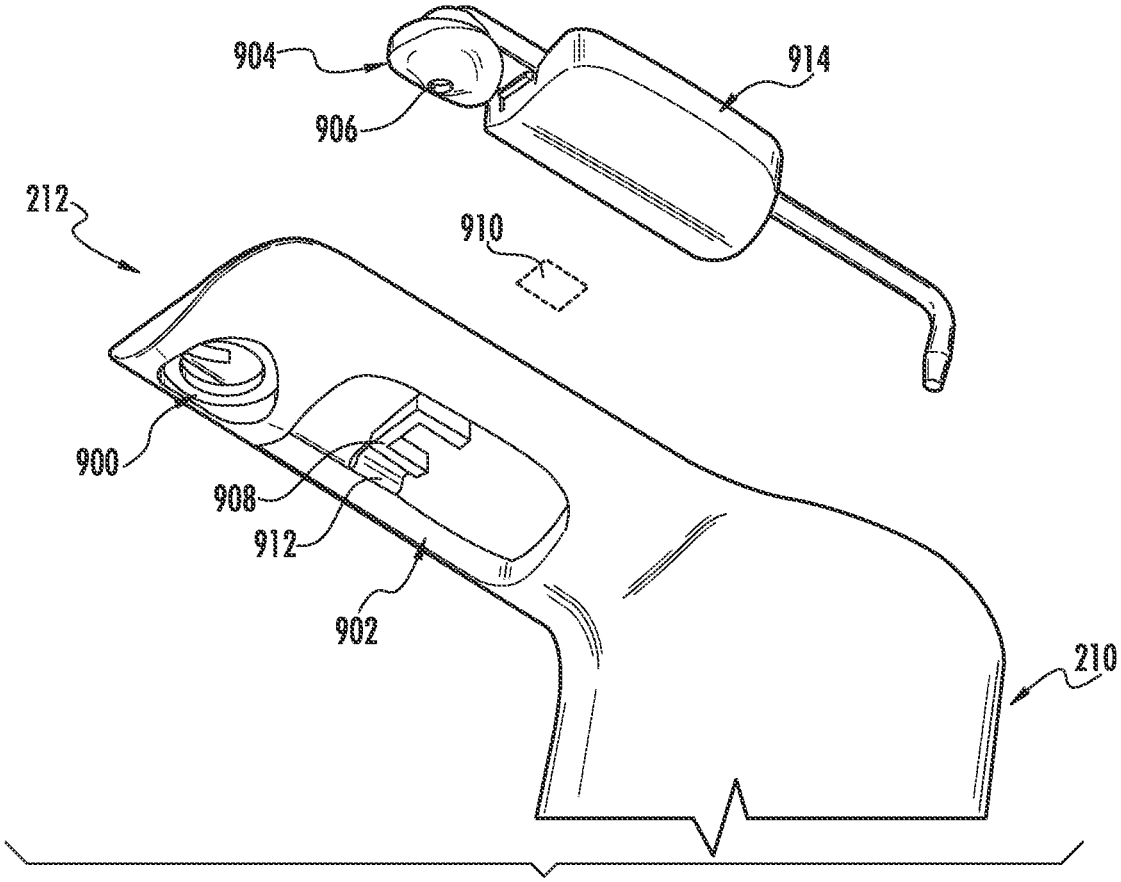
FIG. 19 is an exploded view of a portion of the dispensing device of FIG. 2, according to an example embodiment.

Referring now to FIG. 19, a perspective exploded view of the dispensing arm 212 is shown. Interrupting the outer arm surface 230 may be a plurality of apertures, shown as a nozzle aperture 900 and a sensor aperture 902. The nozzle aperture 900 is configured to receive a flow facilitating device, shown as a nozzle 904. The nozzle 904 defines a generally annular geometry and includes an output 906. The nozzle 904, and specifically the output 906, is configured to discharge a fluid (e.g., air, gas, liquid, Newtonian fluid, etc.) in a direction generally toward the mounting deck 108 once the faucet 100 is mounted to the mounting deck 108. It may be advantageous for the nozzle 904 to be formed of an elastomer such that the nozzle 904 may discharge potential clogs and clots that may exist within the fluid. The nozzle 904 may be coupled within the nozzle aperture 900 using an adhesive, latches, fasteners, interference fit, or other coupling methods.

The dispensing arm 212 further includes, positioned within the sensor aperture 902, a sensor fixture 908 configured to facilitate the positioning of a sensor 910. The sensor fixture 908 may removably couple the sensor 910 to the dispensing arm 212 such that the sensor 910 may be removed and replaced should the sensor 910 malfunction or become damaged. In some embodiments, the sensor 910 is a proximity sensor, configured to send a signal to a faucet controller (not shown) to dispense a fluid from the nozzle 904. In some embodiments, the sensor 910 is a push button, such that when a physical interaction occurs with the sensor 910 (e.g., a push from a user), the push button will send a signal to the faucet controller to discharge a fluid from the nozzle 904.

Also positioned within the sensor aperture 902 may be a conduit fixture 912, positioned proximate to, and in some embodiments abutting, the sensor fixture 908. The conduit fixture 912 is configured to interface with a fluid conduit such that the fluid conduit does not interfere with the operation of the sensor 910. For example, if the sensor 910 is a push button sensor, the conduit fixture 912 may hold on to (e.g., grip, latch to, attach to, etc.) the fluid conduit and hold the fluid conduit to the dispensing arm 212 such that the fluid conduit does not get pinched or pressed when the push button is pressed.

Figure 20:
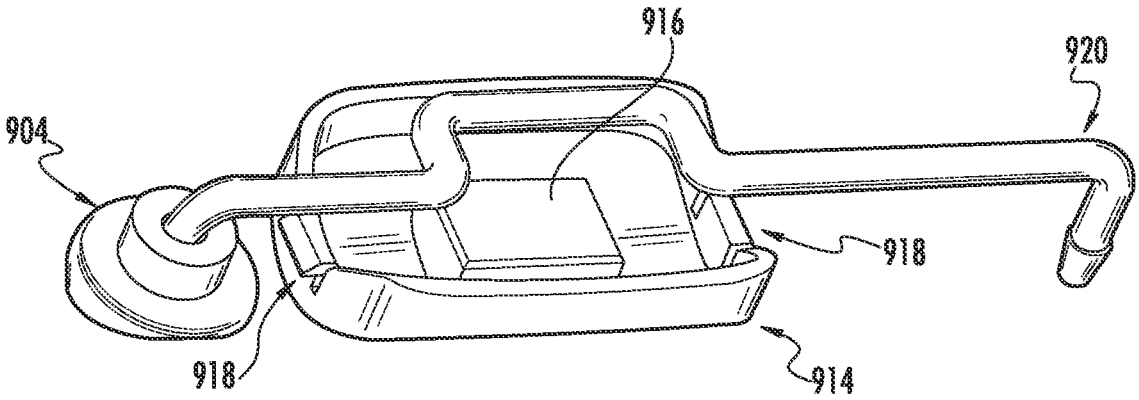
FIG. 20 is a detail view of a portion of the dispensing device of FIG. 2, according to an example embodiment.

The dispensing arm 212 may further include a first sensor interface 914, positioned within and operatively coupled to the sensor aperture 902. In some embodiments, such as when the sensor 910 is a proximity sensor, the first sensor interface 914 may be transparent or translucent such that the sensor 910 positioned behind the first sensor interface 914 may properly function and detect when a foreign body (e.g., hand, dish, etc.) is in close proximity to the nozzle 904. In some embodiments, the first sensor interface 914 is a button cover configured to both protect and actuate the sensor 910 positioned within the sensor fixture 908. To facilitate actuation of the sensor 910, as shown in FIG. 20, the first sensor interface 914 may include a projection 916 configured to interface with and trigger the sensor 910 when a force is applied to the first sensor interface 914 in a direction generally toward the dispensing arm 212. In some embodiments, the first sensor interface 914 is a soft rubber, such as a calculator key, that forms a seal (e.g., watertight seal) with the dispensing arm 212 about a perimeter of the sensor aperture 902. Thus, a force applied to the first sensor interface 914 will bias the projection 916 into the sensor 910, sending a signal to the faucet controller to dispensing a fluid from the nozzle 904. In some embodiments, the first sensor interface 914 is a hard plastic or other non-compliant material. Thus, the first sensor interface 914 may be coupled to the sensor aperture 902 via a plurality of latches 918, the plurality of latches 918 configured to facilitate movement (e.g., travel) of the first sensor interface 914 such that the projection 916 may still interface with the sensor 910 when the first sensor interface 914 is pressed.

In some embodiments, the sensor 910 is a normally-off switch, such that contact with the first sensor interface 914 triggers the sensor 910 (e.g., connects the leads, completes the circuit, etc.), causing the sensor 910 to send a signal to dispense a fluid from the dispensing device 204. In some embodiments, the sensor 910 is a normally-on switch, such that interaction with the first sensor interface 914 interrupts the circuit of the sensor 910. In some embodiments, the sensor 910 is a non-momentary contact switch, such that interaction with the first sensor interface 914, regardless of the duration of the interaction, will trigger the sensor 910 to send a signal. The sensor 910 may be as simple as two electric leads, separated by a distance, such that interaction with the first sensor interface 914 connects the leads and causes the sensor 910 to send a signal (e.g., mechanical keyboard switch, calculator button switch, etc.). The sensor 910 may be an ultrasonic sensor, camera, infrared sensor, or temperature sensor. In some embodiments, the first sensor interface 914 may be a screen, such as a capacitive touch screen, configured to project a light or image that enables a user to see a wash basin in dimly-lit environments and may indicate to the user where the first sensor interface 914 is located by virtue of being lit up (e.g., flashing red, white light, soft blue light, etc.). In some embodiments, the first sensor interface 914 may flash or light up to indicate a fill status of a reservoir in fluid communication with the dispensing arm 212.

Positioned within the dispensing arm 212 and configured to provide a flow of fluid to the output 906 is a fluid conduit 920. The fluid conduit 920 may be formed of a flexible material such that the fluid conduit 920 may be selectively secured within the conduit fixture 912 and away from the sensor 910. The fluid conduit 920 may form an interference fit with the nozzle 904. The fluid conduit 920 may be fluidly separate from the conduits that extend through the neck 104 and deliver water to the spray head 106. In some embodiments, the faucet 100 includes a diverter that is selectively operable between a "mixed" and a "closed" position, where the diverter is configured to divert a portion of the water intended for the spray head 106 to the fluid conduit 920 and to the nozzle 904 when in the "mixed" positon, and the fluid conduit 920 is fluidly separate (e.g., fluidly independent) from the conduits configured to deliver water to the spray head 106.

Figure 21:
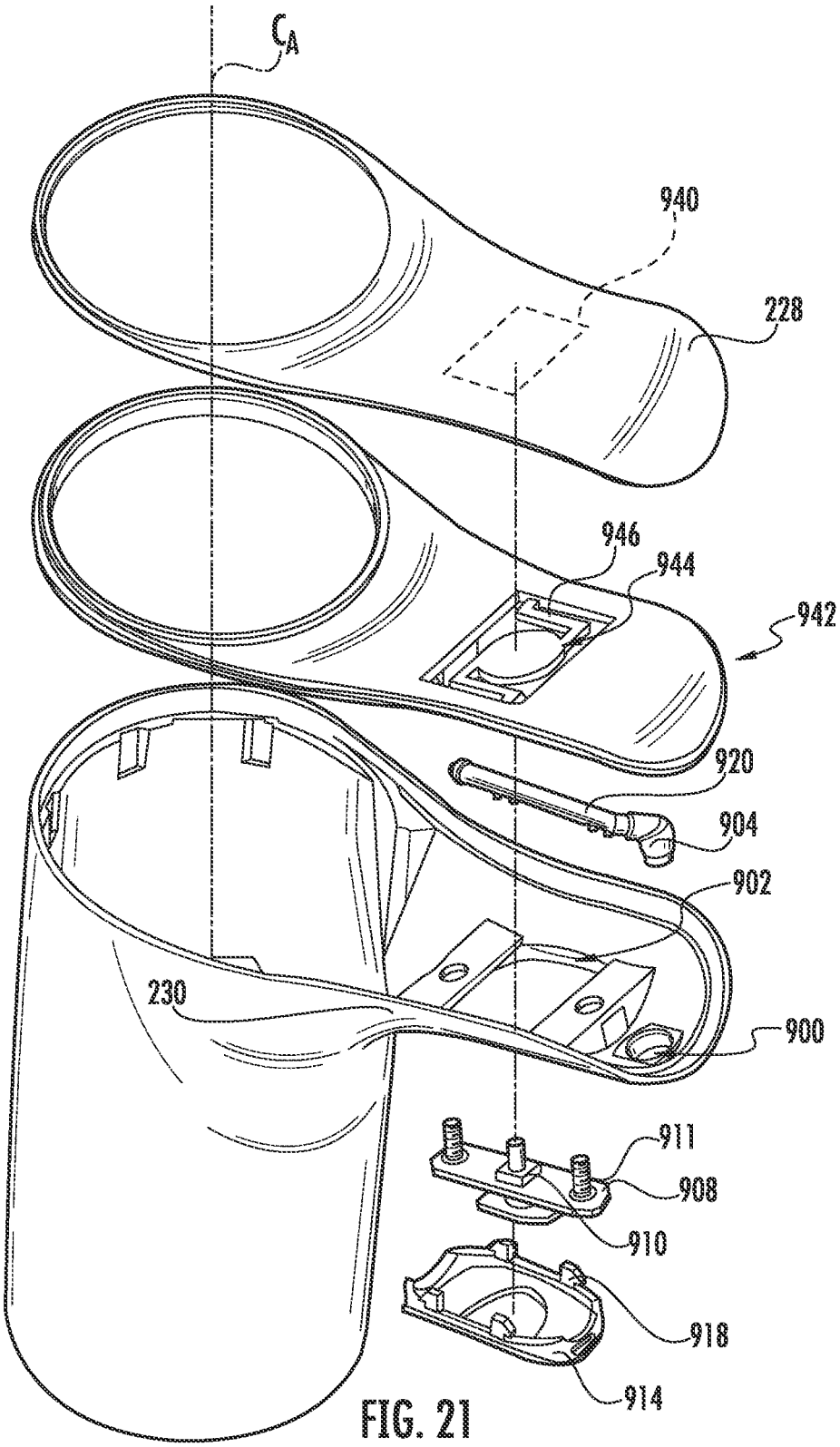
FIG. 21 is an exploded view of the dispensing device of FIG. 7, according to an example embodiment.

Referring now to FIG. 21, a perspective exploded view of the dispensing arm 212 is shown according to another embodiment. The dispensing arm 212 in FIG. 21 is similar to the dispensing arm 212 shown in FIG. 19. Accordingly, like numbering is used to designate like parts between the dispensing arm 212 of FIG. 19 and the dispensing arm 212 of FIG. 21.

Interrupting the outer arm surface 230 may be a plurality of apertures, shown as a nozzle aperture 900 and a sensor aperture 902. The nozzle aperture 900 is configured to receive a flow facilitating device, shown as a nozzle 904. The nozzle 904 is configured to discharge a fluid (e.g., air, gas, liquid, Newtonian fluid, etc.) in a direction generally toward the mounting deck 108 once the faucet 100 is mounted to the mounting deck 108. In some embodiments, the nozzle aperture 900 may be positioned such that the nozzle 904 is configured to direct a flow in an upward direction (e.g., a direction generally toward the handle portion 200. It may be advantageous for the nozzle 904 to be formed of an elastomer such that the nozzle 904 may discharge potential clogs and clots that may exist within the fluid. The nozzle 904 may be coupled within the nozzle aperture 900 using an adhesive, latches, fasteners, interference fit, or other coupling methods.

The dispensing arm 212 further includes, positioned within the sensor aperture 902, a sensor fixture 908 configured to facilitate the positioning of a sensor 910. The sensor fixture 908 may removably couple the sensor 910 to the dispensing arm 212 such that the sensor 910 may be removed and replaced (e.g., by removing fasteners 911) should the sensor 910 malfunction or become damaged. In some embodiments, the sensor 910 is a proximity sensor, configured to send a signal to a faucet controller (not shown) to dispense a fluid from the nozzle 904. In some embodiments, the sensor 910 is a push button, such that when a physical interaction occurs with the sensor 910 (e.g., a push from a user), the push button will send a signal to the faucet controller to discharge a fluid from the nozzle 904. In some embodiments, the sensor 910 is a capacitive sensor configured to send a signal when interacted with by a user.

The dispensing arm 212 may further include a first sensor interface 914, positioned within and operatively coupled to the sensor aperture 902. In some embodiments, such as when the sensor 910 is a proximity sensor, the first sensor interface 914 may be transparent or translucent such that the sensor 910 positioned behind the first sensor interface 914 may properly function and detect when a foreign body (e.g., hand, dish, etc.) is in close proximity to the nozzle 904. In some embodiments, the first sensor interface 914 is a button cover configured to both protect and actuate the sensor 910 positioned within the sensor fixture 908. In some embodiments, the first sensor interface 914 is a soft rubber, such as a calculator key, that forms a seal (e.g., watertight seal) with the dispensing arm 212 about a perimeter of the sensor aperture 902. In some embodiments, the first sensor interface 914 is a hard plastic or other non-compliant material. Thus, the first sensor interface 914 may be coupled to the sensor aperture 902 via a plurality of latches 918, the plurality of latches 918 configured to couple the first sensor interface 914 to the sensor aperture 902.

In some embodiments, the dispensing arm 212 includes a second sensor interface 940 configured to facilitate interaction with the sensor 910. The second sensor interface 940 may be similar to the first sensor interface 914 outlined above (e.g., clear plastic lens, touch screen, bright light, etc.). For example, a user may apply pressure to the second sensor interface 940, the sensor 910 sending a signal in response to an interaction with the second sensor interface 940. The second sensor interface 940 may be integrally formed with the first engagement surface 228. In some embodiments, the second sensor interface 940 directly engages the sensor 910. The second sensor interface 940 may be formed of rubber and overmolded into the first engagement surface 228 formed of a more rigid (e.g., more rigid than the rubber) material, such as a hard rubber, plastic, metal, or similar material.

In some embodiments, the dispensing arm 212 includes a skeleton 942 interposed between the first engagement surface 228 and the sensor 910. The skeleton 942 may define a perimeter similar to a perimeter of the first engagement surface 228. The skeleton 942 may include a compliant center portion 943, made compliant by the inclusion of one or more flexible arms 946. The skeleton 942 may be formed of injection-molded plastic, where the compliance and flexibility of the arm 946 may be a result of the ratio of a cross-sectional area of the arms 946 to a length (e.g., path length) of the arms 946. When a pressure is applied to the second sensor interface 940, the second sensor interface 940 interfaces with the compliant center portion 943, biasing the compliant center portion 943 into the sensor 910 and causing the sensor to send a signal. The sensor 910 may be actuated through interaction with either of the first sensor interface 914 or the second sensor interface 940. In some embodiments, interaction with the first sensor interface 914 triggers the sensor 910 to send a first signal, and interaction with the second sensor interface 940 causes the sensor 910 to send a second signal different from the first signal. For example, a pressure applied to the first sensor interface 914 may trigger the dispensing device 204 to dispense a first fluid (e.g., soap) for a first duration of time (e.g., three seconds), while a pressure applied to the second sensor interface 940 may cause the sensor 910 to send a signal to dispense a second fluid (e.g., nail polish remover, acetone, etc.) for a second duration of time (e.g., one second). In some embodiments, a user may apply a pressure to both the first sensor interface 914 and the second sensor interface 940 at the same time, triggering the sensor 910 to send a third signal to dispense a third liquid (e.g., a soap and water mixture) for a third duration of time (e.g., five seconds). In some embodiments, the second sensor interface 940 is configured to trigger a second sensor different from the first sensor.

Positioned within the dispensing arm 212 and configured to provide a flow of fluid to the output 906 is a fluid conduit 920. The fluid conduit 920 may be formed of a flexible material such that the fluid conduit 920 may be selectively secured within the conduit fixture 912 and away from the sensor 910. The fluid conduit 920 may form an interference fit with the nozzle 904. The fluid conduit 920 may be fluidly separate from the conduits that extend through the neck 104 and deliver water to the spray head 106. In some embodiments, the faucet 100 includes a diverter that is selectively operable between a "mixed" and a "closed" position, where the diverter is configured to divert a portion of the water intended for the spray head 106 to the fluid conduit 920 and to the nozzle 904 when in the "mixed" positon, and the fluid conduit 920 is fluidly separate (e.g., fluidly independent) from the conduits configured to deliver water to the spray head 106.

Figure 22:
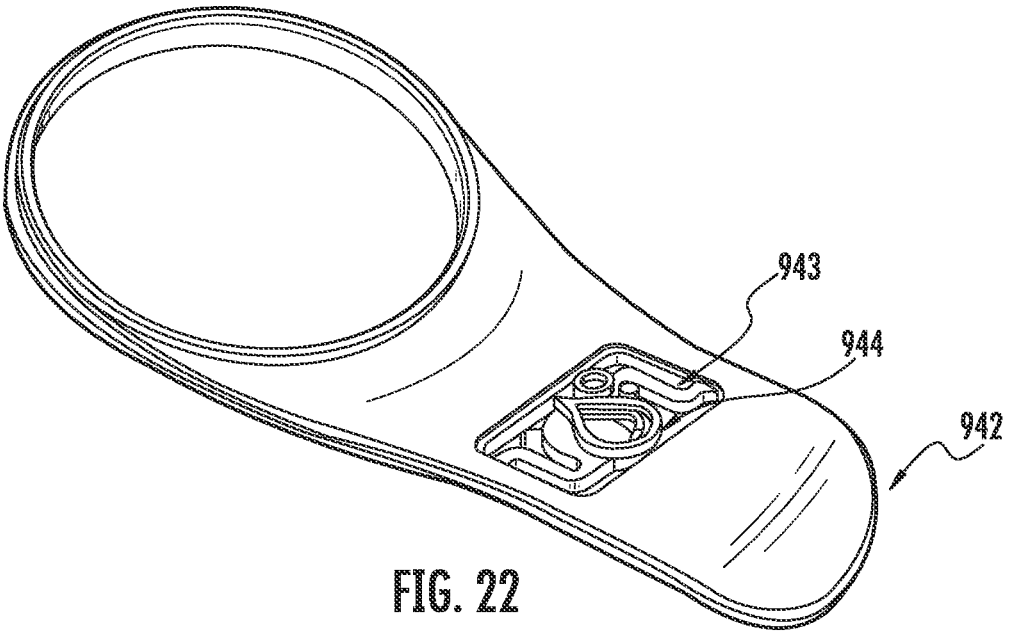
FIG. 22 is a perspective view of a portion of the dispensing device of FIG. 7, according to an example embodiment.
Figure 23:
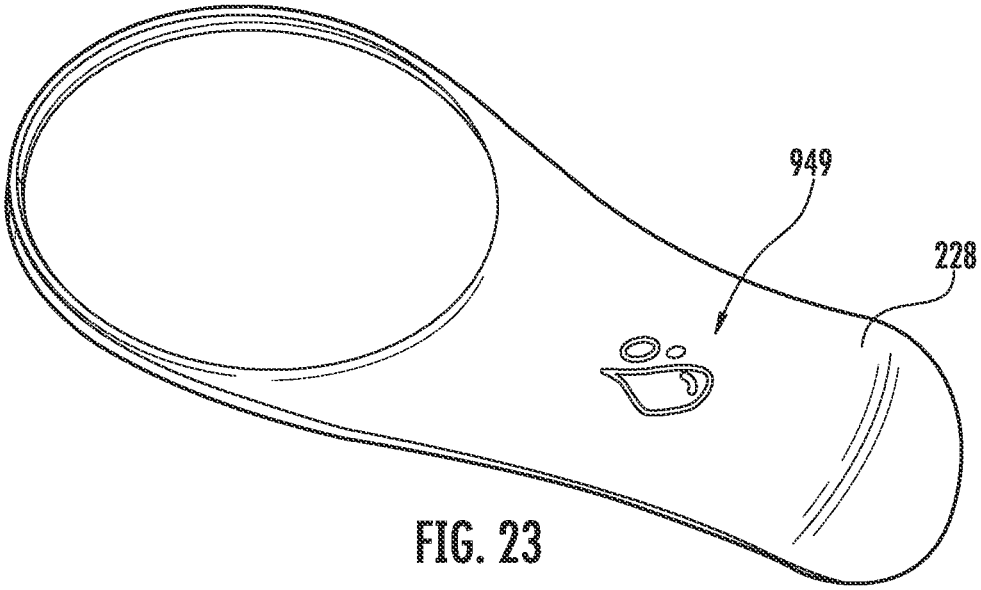
FIG. 23 is a perspective view of a portion of the dispensing device of FIG. 7, according to an example embodiment.

Referring now to FIG. 22, the skeleton 942 is shown according to an example embodiment. The skeleton 942 may include a raised-up indicator 944 positioned on the compliant center portion 943. The raised-up indicator 944 may be formed integrally with the compliant center portion 943. In some embodiments, the raised-up indicator 944 extends through an indicator opening 949 the first engagement surface 228. In some embodiments, the first engagement surface 228 is formed of a polymeric material and is overmolded with the skeleton 942. The raised-up indicator 944 provides a user of the faucet 101 a tactile indication of where the second sensor interface 940 is when the user is not looking at the raised-up indicator 944.

Figure 24:
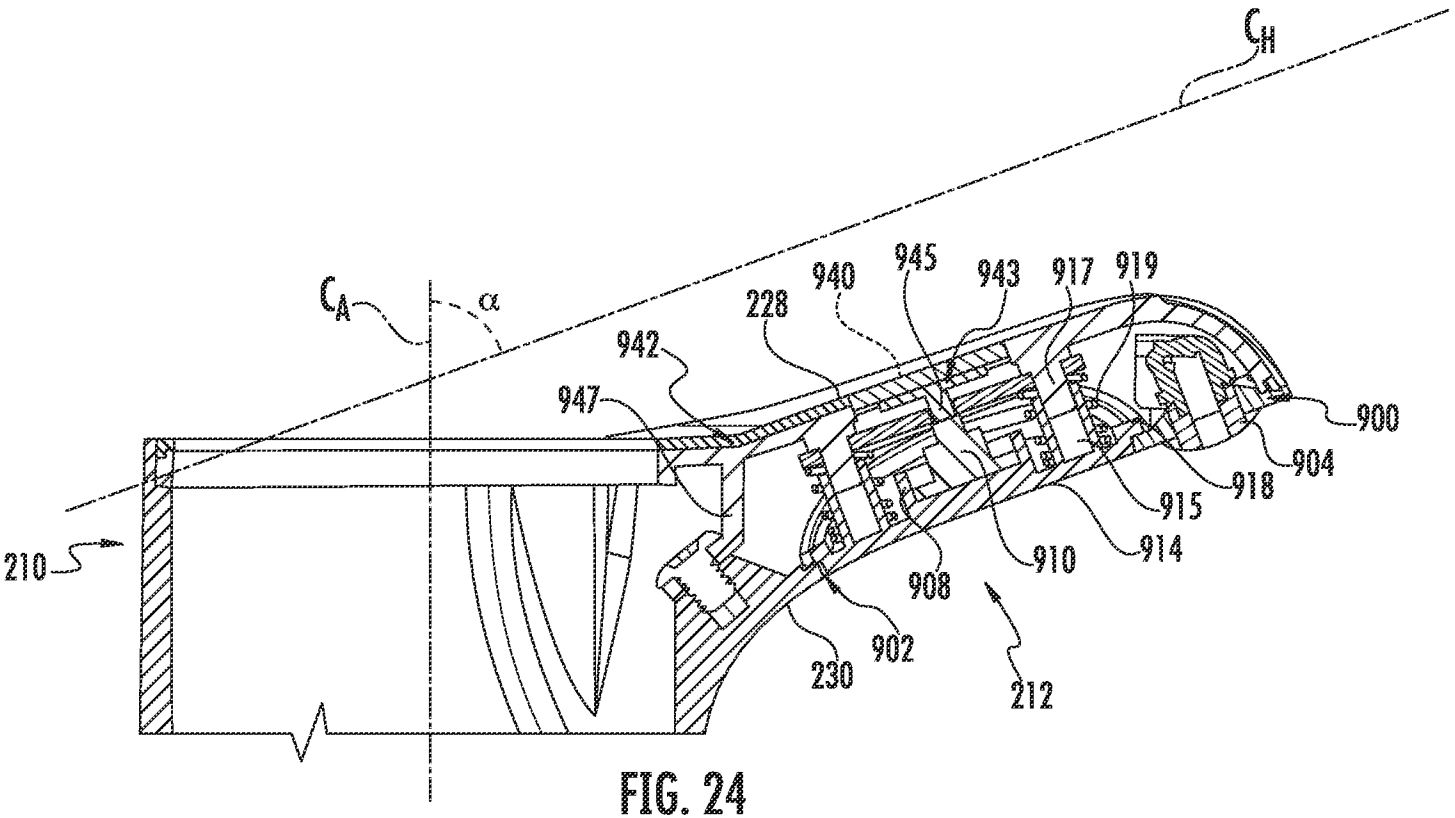
FIG. 24 is a detailed cross-sectional view of the dispensing device of FIG. 7, according to an example embodiment.

Referring now to FIG. 24, a side cross-sectional view of the dispensing arm 212 is shown according to another embodiment. The dispensing arm 212 in FIG. 24 is similar to the dispensing arm 212 shown in FIG. 21. Accordingly, like numbering is used to designate like parts between the dispensing arm 212 of FIG. 21 and the dispensing arm 212 of FIG. 24.

Interrupting the outer arm surface 230 may be a plurality of apertures, shown as a nozzle aperture 900 and a sensor aperture 902. The nozzle aperture 900 is configured to receive a flow facilitating device, shown as a nozzle 904. The nozzle 904 is configured to discharge a fluid (e.g., air, gas, liquid, Newtonian fluid, non-Newtonian fluid, etc.) in a direction generally toward the mounting deck 108 once the faucet 100 is mounted to the mounting deck 108. In some embodiments, the nozzle aperture 900 may be positioned such that the nozzle 904 is configured to direct a flow in an upward direction (e.g., a direction generally toward the handle portion 200). It may be advantageous for the nozzle 904 to be formed of an elastomer such that the nozzle 904 may discharge potential clogs and clots that may exist within the fluid. The nozzle 904 may be coupled within the nozzle aperture 900 using an adhesive, latches, fasteners, interference fit, or other coupling methods.

In some embodiments, the sensor 910 is a proximity sensor, configured to send a signal to a faucet controller (not shown) to dispense a fluid from the nozzle 904. In some embodiments, the sensor 910 is a push button, such that when a physical interaction occurs with the sensor 910 (e.g., a push from a user), the push button will send a signal to the faucet controller to discharge a fluid from the nozzle 904. In some embodiments, the sensor 910 is a capacitive sensor configured to send a signal when interacted with by something conductive (e.g., human finger, touch screen stylus, etc.).

The dispensing arm 212 may further include a first sensor interface 914, positioned within and operatively coupled to the sensor aperture 902. In some embodiments, such as when the sensor 910 is a proximity sensor, the first sensor interface 914 may be transparent or translucent such that the sensor 910 positioned behind the first sensor interface 914 may properly function and detect when a foreign body (e.g., hand, dish, etc.) is in close proximity to the nozzle 904. The first sensor interface 914 may further include a sensor fixture 908 integrally formed with the first sensor interface 914. In some embodiments, the first sensor interface 914 is a button cover configured to both protect and actuate the sensor 910 positioned within the sensor fixture 908. In some embodiments, the first sensor interface 914 is a soft rubber, such as a calculator key, that forms a seal (e.g., watertight seal) with the dispensing arm 212 about a perimeter of the sensor aperture 902. In some embodiments, the first sensor interface 914 is a hard plastic or other non-compliant material. Thus, the first sensor interface 914 may be coupled to the sensor aperture 902 via a plurality of latches 918, the plurality of latches 918 configured to allow movement of the first sensor interface 914 into the dispensing arm 212, but the plurality of latches 918 configured to prevent movement of the first sensor interface 914 out of the dispensing arm 212. The first sensor interface 914 may include a guide channel 915 configured to receive a guide pin 917. The guide channel 915 may extend orthogonally away from the first sensor interface 914 in a direction generally toward the first engagement surface 228. The guide channel 915 may cooperate with the guide pin 917 to facilitate linear movement of the first sensor interface 914 such that actuation of the sensor 910 is reliable and repeatable. As shown, the first sensor interface 914 includes two guide channels 915. However, it should be understood that the first sensor interface 914 may include any number of guide channels 915.

In some embodiments, the dispensing arm 212 includes a second sensor interface 940 configured to facilitate interaction with the sensor 910. For example, a user may apply pressure to the second sensor interface 940, the sensor 910 sending a signal in response to an interaction with the second sensor interface 940. The second sensor interface 940 may be integrally formed with the first engagement surface 228. In some embodiments, the second sensor interface 940 directly engages the sensor 910. The second sensor interface 940 may be formed of rubber and overmolded into the first engagement surface 228 formed of a more rigid (e.g., more rigid than the rubber) material, such as a hard rubber, plastic, metal, or similar material.

In some embodiments, the dispensing arm 212 includes a flexible plastic skeleton 942 interposed between the first engagement surface 228 and the sensor 910. The skeleton 942 may include a compliant center portion 943, made compliant by the inclusion of one or more flexible arms 946 (FIG. 21). When a pressure is applied to the second sensor interface 940, the second sensor interface 940 interfaces with the compliant center portion 943, biasing the compliant center portion 943 into the sensor 910 and causing the sensor to send a signal. In some embodiments, the compliant center portion 943 includes a projection 945 extending orthogonally away from the compliant center portion 943 in a direction generally away from the first engagement surface 228. The projection 945 may interface with the sensor 910 when a pressure or force is applied to the second sensor interface 940. In some embodiments, the projection 945 is configured such that a pressure or force applied to the first sensor interface 914 may cause the sensor 910 to interface with the projection 945.

In some embodiments, the skeleton 942 further includes the guide pin 917, extending orthogonally away from the skeleton 942 in a direction generally away from the first engagement surface 228. The guide pin 917 is configured to be received within the guide channel 915 when the first sensor interface 914 is coupled to the dispensing arm 212. Positioned around the guide pin 917 and the guide channel 915 may be a biasing member, shown as a spring 919. The spring 919 may be configured to apply a force to the skeleton 942 and the first sensor interface 914, biasing the first sensor interface 914 away from the skeleton 942. The spring 919 may apply resistance when a user interacts with the first sensor interface 914, the resistance not enough to prevent actuation of the sensor 910, but the resistance enough to keep the latches 918 engaged with the dispensing arm 212 when no pressure is being applied to the first sensor interface 914 in a direction generally toward the first engagement surface 228, The skeleton 942 may be manufactured separately from the dispensing body 210 and later coupled to the dispensing body, such as by fasteners, adhesive, welding, or similar processes. In some embodiments, the skeleton 942 includes a coupling member 947 extending orthogonally away from the skeleton 942 in a direction generally away from the first engagement surface 228. The coupling member 947 may be configured to receive a fastener to facilitate coupling of the skeleton 942 to the dispensing body 210. Generally speaking, the skeleton 942 provides a rigid structure for the first engagement surface 228 to be coupled to. This allows the first engagement surface 228 to be formed of a soft and compliant material that would otherwise be unable to maintain a fixed shape and position without added support. For example, the first engagement surface 228 may be formed of silicon and coupled to the skeleton 942. In some embodiments, the first engagement surface 228 is overmolded to the skeleton 942.

The sensor 910 may be actuated through interaction with either of the first sensor interface 914 or the second sensor interface 940. In some embodiments, interaction with the first sensor interface 914 triggers the sensor 910 to send a first signal, and interaction with the second sensor interface 940 causes the sensor 910 to send a second signal different from the first signal. For example, a pressure applied to the first sensor interface 914 may trigger the dispensing device 204 to dispense a first fluid (e.g., soap) for a first duration of time (e.g., three seconds), while a pressure applied to the second sensor interface 940 may cause the sensor 910 to send a signal to dispense a second fluid (e.g., nail polish remover, acetone, etc.) for a second duration of time (e.g., one second). In some embodiments, a user may apply a pressure to both the first sensor interface 914 and the second sensor interface 940 at the same time, triggering the sensor 910 to send a third signal to dispense a third liquid (e.g., a soap and water mixture) for a third duration of time (e.g., five seconds). In some embodiments, the second sensor interface 940 is configured to trigger a second sensor different from the first sensor.

Positioned within the dispensing arm 212 and configured to provide a flow of fluid to the output 906 is a fluid conduit 920. The fluid conduit 920 may be formed of a flexible material such that the fluid conduit 920 may be selectively secured within the conduit fixture 912 and away from the sensor 910. The fluid conduit 920 may form an interference fit with the nozzle 904. The fluid conduit 920 may be fluidly separate from the conduits that extend through the neck 104 and deliver water to the spray head 106. In some embodiments, the faucet 100 includes a diverter that is selectively operable between a "mixed" and a "closed" position, where the diverter is configured to divert a portion of the water intended for the spray head 106 to the fluid conduit 920 and to the nozzle 904 when in the "mixed" positon, and the fluid conduit 920 is fluidly separate (e.g., fluidly independent) from the conduits configured to deliver water to the spray head 106.

Figure 25:
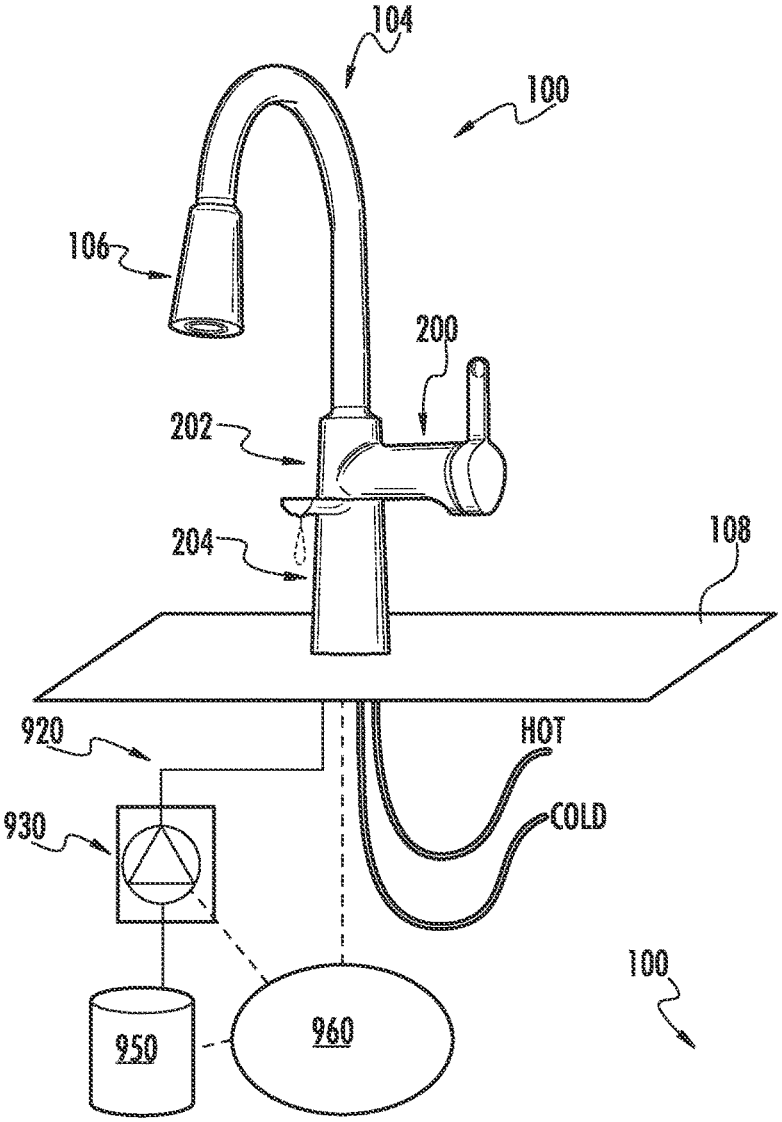
FIG. 25 is a perspective view of the faucet of FIG. 1 having a faucet controller, according to an example embodiment.

Referring now to FIG. 25, a perspective view of the faucet 100 is shown mounted to the mounting deck 108. The fluid conduit 920 extends through the dispensing arm 212, through the first portion 710 of the center shaft 202, through the shank 110, and terminates at a reservoir, shown as a fluid reservoir 950. The fluid reservoir 950 is configured to maintain a supply of fluid and provide the fluid to the fluid conduit 920. The fluid reservoir 950 may be removably coupled the mounting deck 108 such that the fluid reservoir 950 does not take up floor or cabinet space, and so that the fluid reservoir may be removed and refilled if and when the fluid reservoir 950 runs out of fluid. In some embodiments, in-line with the fluid conduit 920 is a pump 930 configured to facilitate the movement of the fluid from the fluid reservoir 950 to the nozzle 904.

The faucet 100 further includes a faucet controller 960, communicatively coupled to the sensor 910, the pump 930, and the fluid reservoir 950. The faucet controller 960 may further be operatively coupled to a power supply 965, such as an AC/DC converter, AC wall outlet, or a battery pack including single-use or rechargeable batteries. When the sensor 910 is activated, the sensor 910 may send a signal to the faucet controller 960 that actuation has occurred. The faucet controller 960 may then send a signal to the pump 930 to actuate and provide fluid from the fluid reservoir 950 to the nozzle 904.

In some embodiments, the faucet controller 960 is operatively coupled to a sensor within the fluid reservoir 950, the sensor configured to determine an amount of fluid remaining in the fluid reservoir 950. In some embodiments, based on the amount of fluid remaining in the fluid reservoir 950, the faucet controller 960 may instruct the pump 930 to actuate at a "low fill" pattern. For example, if the faucet controller 960 instructs the pump 930 to continuously deliver the fluid to the nozzle 904 under normal conditions, the faucet controller 960 may instruct the pump 930 to deliver the fluid to the nozzle 904 in short bursts, such as by delivering small drops quickly (e.g., 4 little drops every second). This may indicate to a user of the dispensing device 204 that the fluid reservoir 950 is low on fluid and may need to be refilled.

In some embodiments, the faucet controller 960 may be configured to discriminate between various interactions with the sensor 910. For example, if the first sensor interface 914 is pressed, or "clicked," by a user, the faucet controller 960 may be configured to detect that the sensor 910 was only pressed briefly (e.g., for less than 1 second). Thus, the faucet controller 960 may instruct the pump 930 to activate for a predetermined amount of time, such as for 1 second. On some occasions, the first sensor interface 914 may be pressed by a user for an extended period of time, such as more than 2 seconds. The faucet controller 960 may then detect that the sensor 910 was activated for an extended period of time, and may instruct the pump 930 to actuate for 3 seconds. In some embodiments, the faucet controller 960 may be programmed to instruct the pump 930 to actuate any time the sensor 910 is activated, such that a user could empty the fluid reservoir 950 by holding the first sensor interface 914. In some embodiments, the faucet controller 960 is programmed to ignore signals from the sensor 910 with a duration of 4 seconds or longer such that the user would only be provided 4 seconds worth of fluid before having to re-actuate the sensor 910, preventing accidental discharge of the entire contents of the fluid reservoir 950 as a fail-safe. In some embodiments, interaction with the second sensor interface 940 may facilitate a similar response from the sensor as interaction with the first sensor interface 914.

In some embodiments, a pressure may be simultaneously applied to both the first sensor interface 914 and the second sensor interface 940 and the sensor 910 may be configured to detect such a simultaneous application of pressures. In response to a simultaneous actuation of pressure to both the first sensor interface 914 and the second sensor interface 940, the sensor 910 may send a signal to the faucet controller 960 to dispense a fluid mixture, such as a mixture of soap and water.

Figure 26:
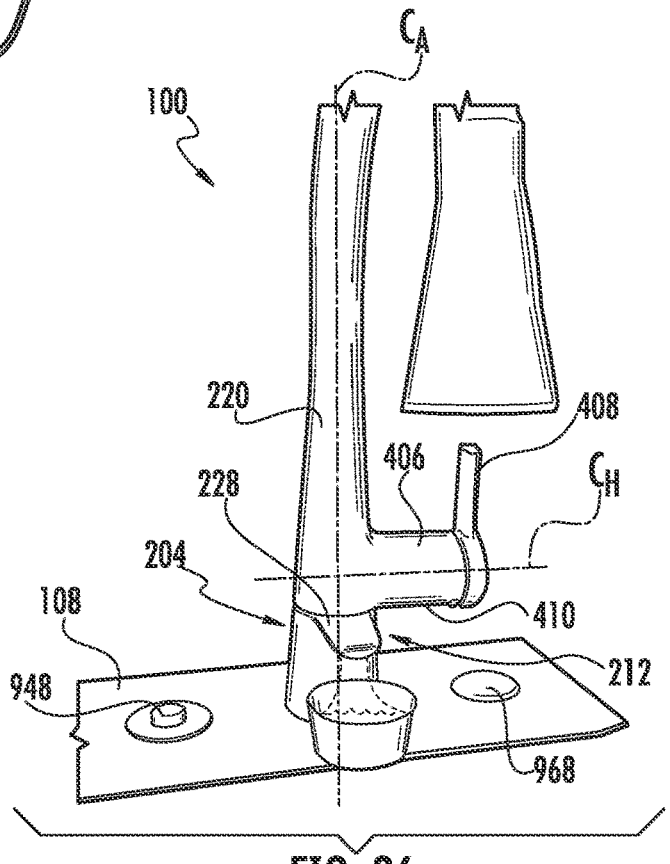
FIG. 26 is a perspective view of the faucet of FIG. 1, according to an example embodiment.
Figure 28:
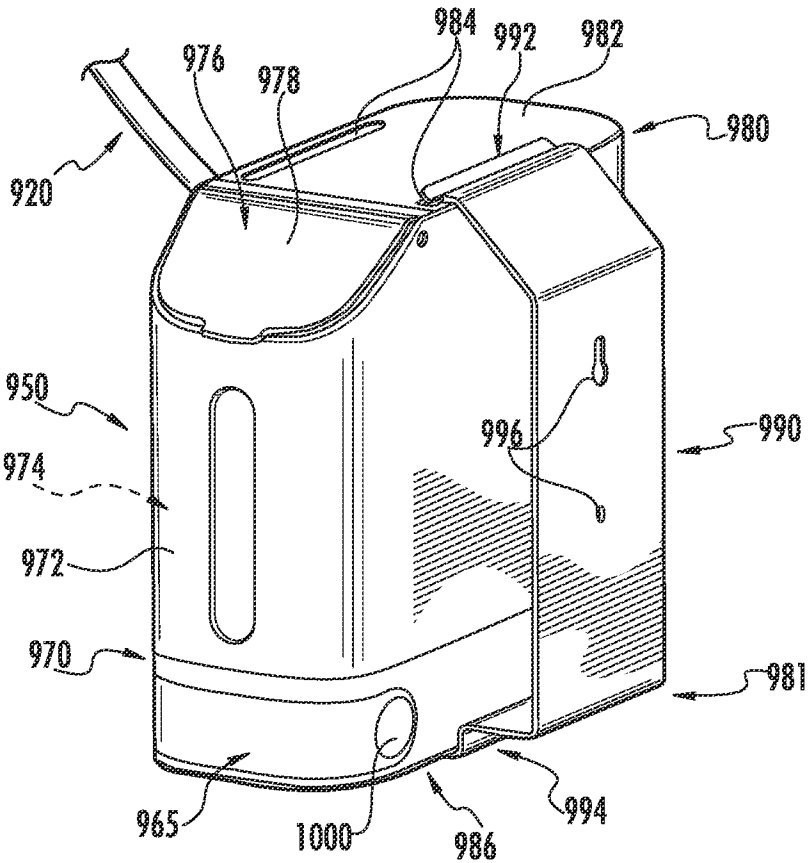
FIG. 28 is a perspective view of the reservoir of FIG. 27, according to an example embodiment.

Referring now to FIG. 26, a perspective view of the faucet 100 is shown mounted to the mounting deck 108. The dispensing device 204 is shown in the second position, with the dispensing arm 212 extending in a direction generally away from the base 102 and over a wash basin, such as a kitchen sink. The first engagement surface 228 is exposed to air and positioned rotationally away from the second engagement surface 410. In some embodiments, the faucet 100 includes a third sensor interface 948 is coupled to the mounting deck 108. The third sensor interface 948 may be mounted in a cut-out portion of the mounting deck 108. For example, the faucet 100 may be used to replace a 2-handle faucet, previously requiring a 3-hole mount in the mounting deck 108 or the wash basin. The third sensor interface 948 may be coupled to one of the holes and form a water-tight seal with the mounting deck 108. The third sensor interface 948 may behave similarly to the first sensor interface 914 outlined above. In some embodiments, the third sensor interface 948 may be selectively locked such that actuation of the third sensor interface 948 may be prohibited, such as by accidently bumping it. To enable the third sensor interface 948 to be enabled, the third sensor interface 948 may be unlocked. This may be true of the first sensor interface 914 and the second sensor interface 940 outlined above.

The nozzle 904 may be configured to provide a flow of fluid, such as dish soap, in a direction generally downward into a wash basin, the flow of fluid traveling generally parallel to the central axis $C_A$. In some embodiments, the nozzle 904 may be configured to provide the flow of fluid at a non-zero angle relative to the central axis $C_A$, such as in a direction at 45-rotational degrees from the central axis $C_A$. In some embodiments, the dispensing device 204 may provide the flow of fluid generally perpendicular to the central axis $C_A$ and generally parallel to the dispensing arm 212. While the nozzle 904 is described as being positioned on an underside of the dispensing arm 212, it should be understood that the nozzle 904 may be positioned anywhere on the outer arm surface 230 or the first engagement surface 228. The nozzle 904 may be positioned such that the dispensing device 204 is able to dispense a fluid from the nozzle 904 in a direction generally away from the dispensing arm 212.

The faucet 100 may further include a plug 968, configured to form a watertight seal with the mounting deck 108 to prevent water from flowing through a hole in the mounting deck 108. In some embodiments, the plug 968 may include a second sensor interface different from the first sensor interface 914. In some embodiments, the third sensor interface 948 may be configured to send a signal to the faucet controller 960 different from the signal sent to the faucet controlled by the first sensor interface 914. For example, when the first sensor interface 914 is engaged, a signal may be sent to the faucet controller to provide dish soap. When the third sensor interface 948 is engaged, a signal may be sent to the faucet controller 960 to provide hand soap from a second fluid reservoir in fluid communication with the dispensing device 204.

While the dispensing device 204 outlined above is described with respect to a faucet for use with a sink, it should be understood that the dispensing device 204 may be integrated into similar faucet-like devices and apparatuses, including but not limited to, shower heads and handheld shower wands in a shower environment, hair salon shampoo stations, and similar devices.

Figure 27:
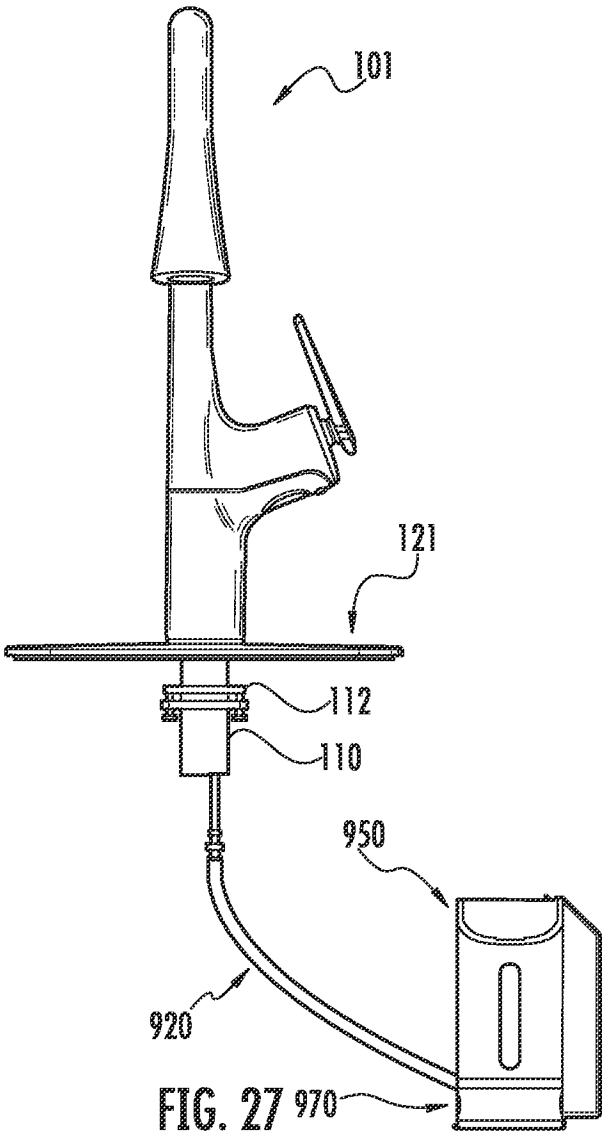
FIG. 27 is a front view of the faucet of FIG. 2 having a reservoir, according to an example embodiment.

Referring now to FIG. 27, the faucet 101 is shown with the fluid reservoir 950, according to an example embodiment. The reservoir 950 includes a translucent body 972 that defines a cavity 974 configured to receive a fluid. The reservoir 950 includes an opening 976 that is selectively closed with a hinged door 978. The door 978 seals the opening 976 to prevent debris from falling into the reservoir 950. In some embodiments, the door 978 fluidly seals the opening 976. Extending along a first end 980 of the reservoir 950 is a lid 982. Extending into the lid 982 is a pair of channels 984. The pair of channels 984 extend lengthwise along the reservoir 950. Opposite to the lid 982 and coupled with a second end 981 of the body 972 is a base 986.

A bracket 990 extends between the lid 982 and the base 986 and is configured to removably couple the reservoir 950 with a wall or other substantially vertical surface, such as a cabinet support or pillar. The bracket 990 includes a hook 992 and a platform 994 opposite to the hook 992. The hook 992 is configured for removably coupling with the pair of channels 984 and the platform 994 is configured for removably coupling with the base 986. When the bracket 990 is coupled to a surface, such as with the pair of mounting apertures 996, the reservoir 950 may be coupled with and removed from the bracket 990 without the use of tools. The reservoir 950 may also be flipped around (e.g., reversed) using the other channel of the pair of channels 984.

The base 986 includes a power supply 965 extending into the base 986 and removably coupled with the base 986. The power supply 965 is configured to receive a wireless power source, such as batteries, rechargeable batteries, and the like. The power supply 965 includes a pair of grip features 1000 that extend into the power supply 965 and are configured to provide a user grip to facilitate removal of the power supply 965 from the base 986.

Figure 30:
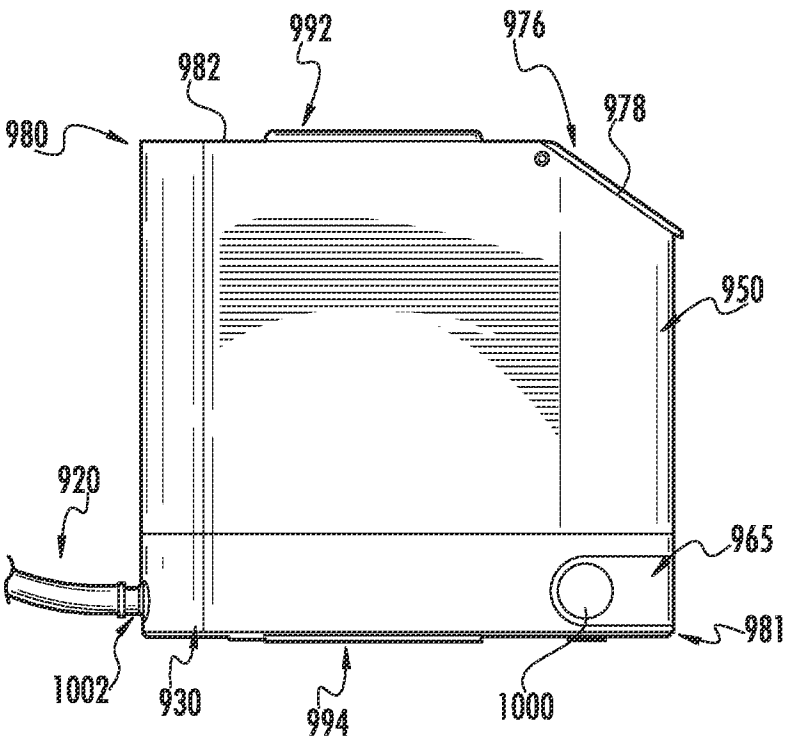
FIG. 30 is a side view of the reservoir of FIG. 27, according to an example embodiment.
Figure 29:
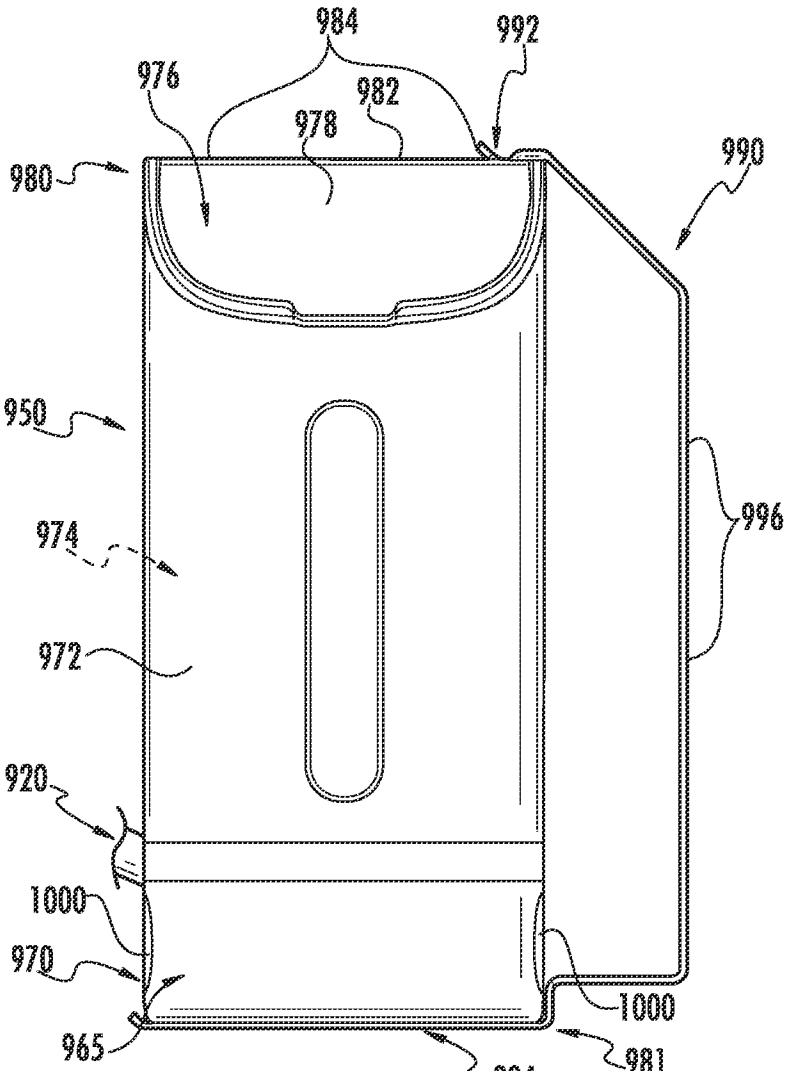
FIG. 29 is a front view of the reservoir of FIG. 27, according to an example embodiment.

Referring now to FIG. 29, a front view of the reservoir 950 is shown. Positioned within the base 986 is the pump 930 configured to deliver a fluid from the cavity 974 to the dispensing device 204. The pump 930 operates depending on an interaction with the first sensor interface 914, the second sensor interface 940, and/or the third sensor interface 948. FIG. 30 shows a side view of the reservoir 950. The fluid conduit 920 is fluidly coupled with the pump 930 positioned in the base 986 and is configured to deliver fluid from the reservoir 950 to the dispensing device 204. In some embodiments, the fluid conduit 920 includes a fitting 1002 configured to be removably coupled from the base 986 and the pump 930. In some embodiments, the fitting 1002 is a quick connect fitting, such as those used for installing a kitchen faucet. In some embodiments, the fitting 1002 is fixedly coupled with the base 986 and the pump 930, such as with threads, bayonet connectors, and the like.

While this specification contains many specific implementation details, these should not be construed as limitations on the scope of what may be claimed but rather as descriptions of features specific to particular implementations. Certain features described in this specification in the context of separate implementations can also be implemented in combination in a single implementation. Conversely, various features described in the context of a single implementation can also be implemented in multiple implementations separately or in any suitable subcombination. Moreover, although features may be described as acting in certain combinations and even initially claimed as such, one or more features from a claimed combination can, in some cases, be excised from the combination, and the claimed combination may be directed to a subcombination or variation of a subcombination.

As utilized herein, the term "approximately," "generally," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the present disclosure as recited in the appended claims.

The term "coupled" and the like, as used herein, mean the joining of two components directly or indirectly to one another. Such joining may be stationary (e.g., permanent) or moveable (e.g., removable or releasable). Such joining may be achieved with the two components or the two components and any additional intermediate components being integrally formed as a single unitary body with one another, with the two components, or with the two components and any additional intermediate components being attached to one another.

It is important to note that the construction and arrangement of the system shown in the various example implementations is illustrative only and not restrictive in character. All changes and modifications that come within the spirit and/or scope of the described implementations are desired to be protected. It should be understood that some features may not be necessary, and implementations lacking the various features may be contemplated as within the scope of the application, the scope being defined by the claims that follow. When the language "a portion" is used, the item can include a portion and/or the entire item unless specifically stated to the contrary.

Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, Z, X and Y, X and Z, Y and Z, or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

Additionally, the use of ranges of values (e.g., W to P, etc.) herein are inclusive of their maximum values and minimum values (e.g., W to P includes W and includes P, etc.), unless otherwise indicated. Furthermore, a range of values (e.g., W to P, etc.) does not necessarily require the inclusion of intermediate values within the range of values (e.g., W to P can include only W and P, etc.), unless otherwise indicated.

What is claimed is:

1. A faucet comprising:

a center shaft centered on an axis, the axis transverse to a mounting deck on which the faucet is installed;

a base, including:

a handle portion extending away from the center shaft and coupled to the center shaft, the handle portion defining an outer handle surface; and a dispensing device rotatably coupled to the center shaft about the axis, the dispensing device comprising:

a dispensing body defining a first end proximate to the handle portion, and a second end opposite the first end, wherein the second end is configured to interface with the mounting deck; and a dispensing arm coupled to the dispensing body and extending away from the dispensing body, the dispensing arm defining an outer arm surface, the dispensing device rotatable with respect to the handle portion from a first position to a second position, wherein in the first position the dispensing arm is arranged below the handle portion such that the outer arm surface and the outer handle surface define at least 95% of a perimeter of a rounded polygon cross-sectional shape of the dispensing arm and the handle portion; and a neck extending from the base to a spray head configured to deliver water from the faucet, wherein the dispensing device is configured to receive the center shaft, the dispensing body defining an unbroken annular body centered on the axis.

2. The faucet of claim 1, wherein:

the dispensing arm further comprises a first engagement surface contiguous with the first end of the dispensing body; and the handle portion further comprises a second engagement surface proximate to the first end of the dispensing body and in the first position the second engagement surface is abutting the first engagement surface.

3. The faucet of claim 1, wherein the dispensing arm has a geometry that is complementary to a geometry of the handle portion such that in the first position the dispensing arm nests with the handle portion to form a continuous visual surface.

4. The faucet of claim 1, wherein the dispensing arm further comprises:

a sensor positioned within the dispensing arm and coupled with the dispensing arm; and a sensor interface positioned on the outer arm surface;

wherein the sensor sends a signal to discharge a fluid from the dispensing arm when the sensor interface is engaged.

5. The faucet of claim 4, wherein the sensor interface is hidden from view when the dispensing arm is nested with the handle portion.

6. The faucet of claim 1, wherein the handle portion extends at a first angle relative to the axis and the dispensing arm extends at a second angle relative to the axis, wherein the first angle and the second angle are between 60 degrees and 80 degrees, inclusive.

7. The faucet of claim 1, wherein the first position and the second position are separated by less than 360 rotational degrees in either rotational direction.

8. A faucet comprising:

a center shaft centered on an axis, the axis transverse to a mounting deck on which the faucet is installed;

a base, including:

a handle portion extending away from the center shaft, the handle portion including a control lever positioned opposite the center shaft and at a distal end of the handle portion, the control lever configured to facilitate a flow of water through the center shaft, the handle portion defining an outer handle surface; and a dispensing device rotatably coupled to the center shaft about the axis, comprising:

a body having a first end and a second end opposite the first end, wherein the second end is configured to interface with the mounting deck; and an arm coupled to the body proximate to the first end, the arm comprising a nozzle, a sensor positioned within the arm and coupled to the arm, and a sensor interface operable to actuate the sensor positioned within the arm, the arm defining an outer arm surface, the dispensing device rotatable with respect to the handle portion from a first position to a second position, wherein in the first position the arm is arranged below the handle portion such that the outer arm surface and the outer handle surface define at least 95% of a perimeter of a rounded polygon cross-sectional shape of the arm and the handle portion; and a neck extending from the base to a spray head configured to deliver water from the faucet, wherein the dispensing device is configured to receive the center shaft, the body of the dispensing device defining an unbroken annular body centered on the axis.

9. The faucet of claim 8, further comprising a conduit configured to receive a fluid from a fluid reservoir and deliver the fluid to the arm.

10. The faucet of claim 8, further comprising a faucet controller, the faucet controller operatively coupled to the sensor and configured to receive a signal from the sensor.

11. The faucet of claim 8, wherein the sensor is a push button, and the sensor interface further comprises a projection configured to interface with the sensor.

12. The faucet of claim 8, wherein the body is rotatable and operable in a plurality of positions.

13. A faucet comprising:

a center shaft defining a central axis, the central axis transverse to a mounting deck on which the faucet is installed;

a base, including:

a handle portion extending away from the center shaft and coupled to the center shaft, the handle portion including a control lever positioned opposite the center shaft and at a distal end of the handle portion, the control lever configured to facilitate a flow of water through the center shaft, the handle portion defining an outer handle surface; and a dispensing device rotatably coupled to the center shaft and arranged below the handle portion, the dispensing device positionable between a nested position and a use position and comprising:

a dispensing body defining a first end and a second end opposite the first end, wherein the second end is configured to interface with the mounting deck, and a dispensing arm coupled to the dispensing body proximate to and extending orthogonally away from the dispensing body, the dispensing arm comprising:

a sensor coupled within the dispensing arm and configured to send a signal to a controller to discharge a fluid from the dispensing arm;

a first sensor interface operable to actuate the sensor when the dispensing device is in either one of the nested position and the use position;

a second sensor interface operable to actuate the sensor when the dispensing device is in the use position; and an outer arm surface, the dispensing device rotatable with respect to the handle portion between the nested position to the use position, wherein in the nested position the dispensing arm is arranged below the handle portion such that the outer arm surface and the outer handle surface define at least 95% of a perimeter of a rounded polygon cross-sectional shape of the dispensing arm and the handle portion; and a neck extending from the base to a spray head configured to deliver water from the faucet, wherein the dispensing device is configured to receive the center shaft, the dispensing body defining an unbroken annular body centered on the central axis.

14. The faucet of claim 13, wherein in the nested position the second sensor interface is hidden from view.

15. The faucet of claim 13, further comprising a detent operably coupled between the center shaft and the dispensing device, the detent configured to maintain the dispensing device in one of the nested position and the use position.

16. The faucet of claim 13, wherein the dispensing arm extends away from the dispensing body at an angle, the angle being between 60 rotational degrees and 80 rotational degrees, inclusive.

* * * * *